US011084623B1

(12) United States Patent
Ankele et al.

(10) Patent No.: US 11,084,623 B1
(45) Date of Patent: Aug. 10, 2021

(54) TRACKABLE NYLON PALLET AND COLLAPSIBLE CONTAINER

(71) Applicants: David Ankele, Santa Clara, CA (US); Dale Woiken, Upland, CA (US)

(72) Inventors: David Ankele, Santa Clara, CA (US); Dale Woiken, Upland, CA (US)

(73) Assignee: David Ankele, Santa Clara, CA (US)

( * ) Notice: Subject to any disclaimer, the term of this patent is extended or adjusted under 35 U.S.C. 154(b) by 0 days.

(21) Appl. No.: 17/301,066

(22) Filed: Mar. 23, 2021

(51) Int. Cl.
*B65D 19/00* (2006.01)
*B65D 19/18* (2006.01)

(52) U.S. Cl.
CPC ..... *B65D 19/18* (2013.01); *B65D 2519/009* (2013.01); *B65D 2519/00034* (2013.01); *B65D 2519/00069* (2013.01); *B65D 2519/00174* (2013.01); *B65D 2519/00208* (2013.01); *B65D 2519/00243* (2013.01); *B65D 2519/00273* (2013.01); *B65D 2519/00288* (2013.01); *B65D 2519/00318* (2013.01); *B65D 2519/00497* (2013.01); *B65D 2519/00537* (2013.01); *B65D 2519/00666* (2013.01)

(58) Field of Classification Search
CPC ..... B65D 19/18; B65D 2519/00034; B65D 2519/00069; B65D 2519/00174; B65D 2519/00208; B65D 2519/00243; B65D 2519/00273; B65D 2519/00288; B65D 2519/00318; B65D 2519/00497; B65D 2519/00537; B65D 2519/00666; B65D 2519/00875; B65D 2519/009
See application file for complete search history.

(56) References Cited

U.S. PATENT DOCUMENTS 4,674,647 A 6/1987 Gyenge et al.
5,199,589 A * 4/1993 Noble ..... B65D 19/18 217/15
5,788,103 A * 8/1998 Wagner ..... B65D 11/1833 206/600
6,135,287 A * 10/2000 Hartwall ..... B65D 19/18 206/600
6,305,726 B1 10/2001 LeTrudet
6,357,590 B1 * 3/2002 Karpisek ..... B65D 19/38 206/386
6,772,897 B2 8/2004 Kellerer et al.
8,413,831 B2 4/2013 Nolan
(Continued)

*Primary Examiner* — Matthew W Ing
(74) *Attorney, Agent, or Firm* — Charles L. Thoeming

(57) ABSTRACT

Trackable nylon pallets and collapsible containers constructed from injection molded, interlocking top and bottom pallet portions having attached, hinged collapsible container sides affixed to the pallet top side. Collapsible side locking assemblies and a container cover provide stability to container side when they are orthogonally disposed to the pallet top side. The cover also provides pallet and collapsible container stacking stability when the collapsed sides are folded inwards and resting on the pallet top side. Each pallet and collapsible container provide real time tracking, identification, and monitoring capabilities from at least one removable communication/sensor box releasably secured between conjoined top and bottom pallet portions. Each trackable pallet and collapsible container provide equipment entry passages between top and bottom portions from all four pallet sides.

18 Claims, 20 Drawing Sheets

(56) References Cited

U.S. PATENT DOCUMENTS

| | | | | |
|---|---|---|---|---|
| 8,434,618 | B2 * | 5/2013 | Mitchell | B65D 19/06 206/386 |
| 8,511,496 | B2 | 8/2013 | Van Der Korput et al. | |
| 8,727,158 | B2 | 5/2014 | Nolan | |
| 9,242,761 | B2 * | 1/2016 | Iwata | B65D 19/18 |
| 9,422,082 | B2 | 8/2016 | Nolan et al. | |
| 2003/0102309 | A1 * | 6/2003 | Hartwall | B65D 77/061 220/6 |
| 2008/0114487 | A1 * | 5/2008 | Schuler | G06Q 10/06 700/217 |
| 2008/0169285 | A1 | 7/2008 | Marazita et al. | |
| 2014/0224795 | A1 * | 8/2014 | Parnall | B65D 19/18 220/7 |
| 2014/0231425 | A1 * | 8/2014 | Jian | E05D 3/06 220/7 |
| 2017/0341857 | A1 * | 11/2017 | Jian | B65D 88/522 |
| 2021/0009310 | A1 * | 1/2021 | Moeller | G06Q 10/0833 |

* cited by examiner

TRACKABLE NYLON PALLET AND COLLAPSIBLE CONTAINER

The invention relates to pallets with integral collapsible Gaylord-type containers made of nylon, and useful methods for their preparation and use.

BACKGROUND

Transport and storage pallets and containers made of plastic are widely used in national and international trade. These pallets and containers protect and carry their contents during storage and transport, and there is a growing need for durable pallets and containers that efficiently maintain the quality of their contents.

One especially useful transport and storage container is the pallet with collapsible containers using a structural platform pallet made of metal, wood, or plastic materials. Wooden pallets and collapsible containers have been around for several years used, but their production and maintenance make them unwieldy and expensive. In addition, wooden pallets and collapsible containers have limited useful life due to adverse weather and can fail due to rotting when they are wet. In addition, wooden pallets and collapsible containers are assembled by fastener means such as glue, nails, or staples. Harsh weather conditions also accelerate the decline of these fasteners leading to failure of the wooden pallets and collapsible containers.

The potential for insect infestation also presents a growing need to treat wooden pallets and collapsible containers created before export. For nearly twenty years, the European Union has required heat treatment or chemical treatment for all unprocessed wood pallets and collapsible containers made from conifers. Freight transport on wooden pallets and collapsible containers that do not meet these requirements are rejected at the border. It is even more likely is that such non-compliant wooden pallets with Gaylord type containers are destroyed at the expense of the shipper.

Metal pallets and collapsible containers also have problems. Typically, they are expensive, heavy, and susceptible to corrosion.

Plastic pallets and collapsible containers, including High-density Polyethylene ("HDPE"), present possible flammability issues and related problems. If fire occurs, plastic pallets and collapsible containers are susceptible to flow, resulting in molten plastic leads, whereby the heat and fire spreads. The National Fire Protection Association has issued Forced Regulations that the usefulness of plastic pallets and collapsible containers to reduce these hazards. These Regulations impose that plastic pallets and collapsible containers have a composition comprising a thermosetting resin, which may be an epoxy resin, and a plurality of thermoplastic resins. These compositions may contain, for example, flame retardants. One known approach is constructions of polyvinylchloride pallets having a polyolefin upper deck and a polycarbonate or polyphenylene lower deck. Other approaches employ a polyolefin/halogenated epoxy pallet and collapsible container composition, where the halogenated epoxide acts as a flame retardant, optionally combined with a second flame retardant. These retardant regulations impose the expense of one or more of these additional and complex manufacturing component chemical subparts.

Another limitation for goods stored and transported on pallets and collapsible containers internationally are that the specific goods are not trackable, monitored, or accounted for between a shipping port and a receiving port of entry.

Finally, a further limitation for goods stored and transported on pallets and collapsible containers internationally are that during transport or storage the specific goods are subjected to extreme environmental conditions that degrade or spoil the transported goods with no means for alerting the sending party, the transporting party, or the receiving party of these conditions during storage and transport.

Thus there is a need for an improved pallet and collapsible container constructed of nylon that is durable and that overcomes the many limitations of existing metal, wood, and plastic pallets and containers.

There is yet a further need for an improved pallet and collapsible container construction of nylon that provides a low profile, high weight capacity product with pallet jack, forklift, and pallet equipment (PE) access from all sides through openings within the pallet portion so the improved pallet and collapsible container can be used with most material handling equipment including forklifts, pallet jacks, PE, and palletizers and other standard material handling equipment used in the art.

There is a further need for an improved pallet and collapsible container constructed of nylon rated to have a "no flashpoint" rating by either Underwriting Laboratories or nylon manufacturers making nylon a natural fire-resistant material eliminating any need for fire retardants. Constant re-evaluation of carcinogens in fire retardant means for plastic pallets and collapsible containers under the Environment Protection Act make plastic pallets and collapsible containers potential targets for recalls for the fire-retardant chemicals. The improved nylon pallet and collapsible container overcomes this limitation of plastic pallets and collapsible containers and makes the improved nylon pallet and collapsible container suited for the food and pharmaceutical industries.

A further need for an improved pallet and collapsible container constructed of nylon is using only recycled nylon for the improved nylon pallet and collapsible container manufacture, thus greatly decreasing the environmental carbon footprint of such durable improved pallets and collapsible containers. The nylon pallets and collapsible containers would also be recyclable into new nylon pallets and collapsible containers at the end of each improved nylon pallet's useful life cycle.

There is yet a further need for an improved nylon pallet and collapsible container that includes data collecting capabilities using RFID/GPS hybrid cellular based tags and/or sensors for temperature and environmental gasses such as carbon dioxide for data transmission during storage and transport, and use of other block-chain technologies, to maximize pallet platform and data potential, to meet the needs of shippers, transporters, and recipients, and to fulfil governmental regulations and industry standards.

A further need exists for an improved nylon pallet and collapsible container capable of accepting custom designed removable locking casters providing more flexibility where forklifts, pallet jacks, or PE cannot access or move pallets in tight spaces. This feature allows pallet interlinking to enhance forklift utility in pulling multiple loads at a time saving forklift trips. Locking casters also allow movement of heavily loaded pallets on a warehouse floor without the need of forklifts, pallet jacks, or PE.

DISCLOSURE OF INVENTION

An embodiment of the trackable nylon pallet and collapsible container provides a rigid, injection molded nylon bottom pallet portion having a square planar bottom side and a square top side, four equal length sides providing two longitudinal sides and two transverse sides, and four ninety-degree corners. A plurality of equal sized upstanding nylon posts is affixed to the bottom portion top side in arrays of upstanding nylon posts with extended nylon attachment clips and upstanding nylon posts with an open end sized to receive the extended nylon attachment clip.

An embodiment of the trackable nylon pallet and collapsible container also provides a rigid, injection molded nylon top pallet portion of equal size to the bottom portion and comprising a square bottom side and a square planar top side, four equal length sides providing two longitudinal sides and two transverse sides, and four ninety-degree corners. A plurality of equal sized upstanding nylon posts is affixed to the top pallet portion bottom side in arrays of upstanding nylon posts with extended nylon attachment clips and upstanding nylon posts with an open end sized to receive the extended nylon attachment clip. The pallet portion planar top side further provides a first upstanding side orthogonally disposed to the planar top side along one planar top side edge, a second upstanding side orthogonally disposed to the planar top side along the opposing planar top side edge, and a third upstanding side orthogonally disposed to the planar top side along a planar top side edge between the first and second upstanding side. The planar top side further provides first and second transverse sides between the first upstanding side and the second upstanding side to provide alternating insertion and projection portions defining a common longitudinal channel the length of each respective planar top side transverse side. Both first and second upstanding sides include alternating insertion and projection portions defining a common longitudinal channel the length of each planar top side upstanding side and transverse apertures aligned with the common longitudinal channels provided by the alternating insertion and projection portions on the third upstanding side and a fourth side between the first upstanding side and the second upstanding side.

An embodiment of the trackable nylon pallet and collapsible container provides rigid, injection molded nylon collapsible side portions including alternating insertion and projection portions defining a common longitudinal channel along collapsible side portion bottom side lengths and corresponding to the alternating insertion and projection portions of the planar top side defining common longitudinal channels. A hinge rod sized to be received into each of the four common longitudinal channels and associated hinge barrel between the collapsible sides and the pallet planar top side connect the collapsible sides to the pallet planar top side and allows the collapsible sides to fold inward towards the pallet planar top side when the collapsible box of the trackable nylon pallet and collapsible container is not in use. The heights of the collapsible sides are varied to provide stacking the collapsible sides on one another when folded inwards towards the pallet planar top side.

An embodiment of the trackable nylon pallet and collapsible container includes a rigid, injection molded nylon top cover extending down from four collapsible sides when extended to the common box height or over the folded inwards, collapsible sides resting on the pallet planar top side when the collapsible box of the trackable nylon pallet and collapsible container is not in use.

An embodiment of the trackable nylon pallet and collapsible container provides top locking assemblies to releasably engage adjacent collapsible sides when the collapsible box of the trackable nylon pallet and collapsible container is in use.

An embodiment of the trackable nylon pallet and collapsible container provides hinge barrels affixed to the collapsible side bottom alternating insertion and projection portions, each hinge barrel sized to receive the respective hinge rod within the respective defined longitudinal channel and secure the respective collapsible bottom side to the pallet top portion.

An embodiment of the trackable nylon pallet and collapsible container includes a nylon locking pin to secure each upstanding nylon post with extended attachment clip to each upstanding nylon post open end securing the interlocking of the pallet top portion and the pallet bottom portion of the nylon pallet and collapsible container.

An embodiment of the trackable nylon pallet and collapsible container includes an interchangeable communications/sensor box providing an integral global positioning system, at least one integral radio frequency identification device, at least one integral temperature sensor, at least one integral sensor calibrated to detect chemicals, an integral power supply and connected wiring to power components housed in the communications/sensor box.

An embodiment of the trackable nylon pallet and collapsible container includes at least one integral frame sized to receive and hold the interchangeable communications box without the necessity of opening or otherwise breaking down the nylon pallet.

An embodiment of the trackable nylon pallet and collapsible container provides a low profile, high weight capacity nylon pallet with pallet jack, forklift, and pallet equipment (PE) access from all sides through openings within the pallet so the improved pallet can be used with most material handling equipment including forklifts, pallet jacks, PE, and palletizers and other standard material handling equipment used in the art.

Each nylon pallet portion of embodiments of the trackable nylon pallet and collapsible container can withstand a rack able load of 2,722 kg, and a static load of 45,359 kg.

BRIEF DESCRIPTION OF DRAWINGS

These and other features, aspects, and advantages of the trackable nylon pallet and collapsible container will become better understood regarding the following description, and drawings as further described.

BEST MODE FOR CARRYING OUT THE INVENTION

Figure 1:
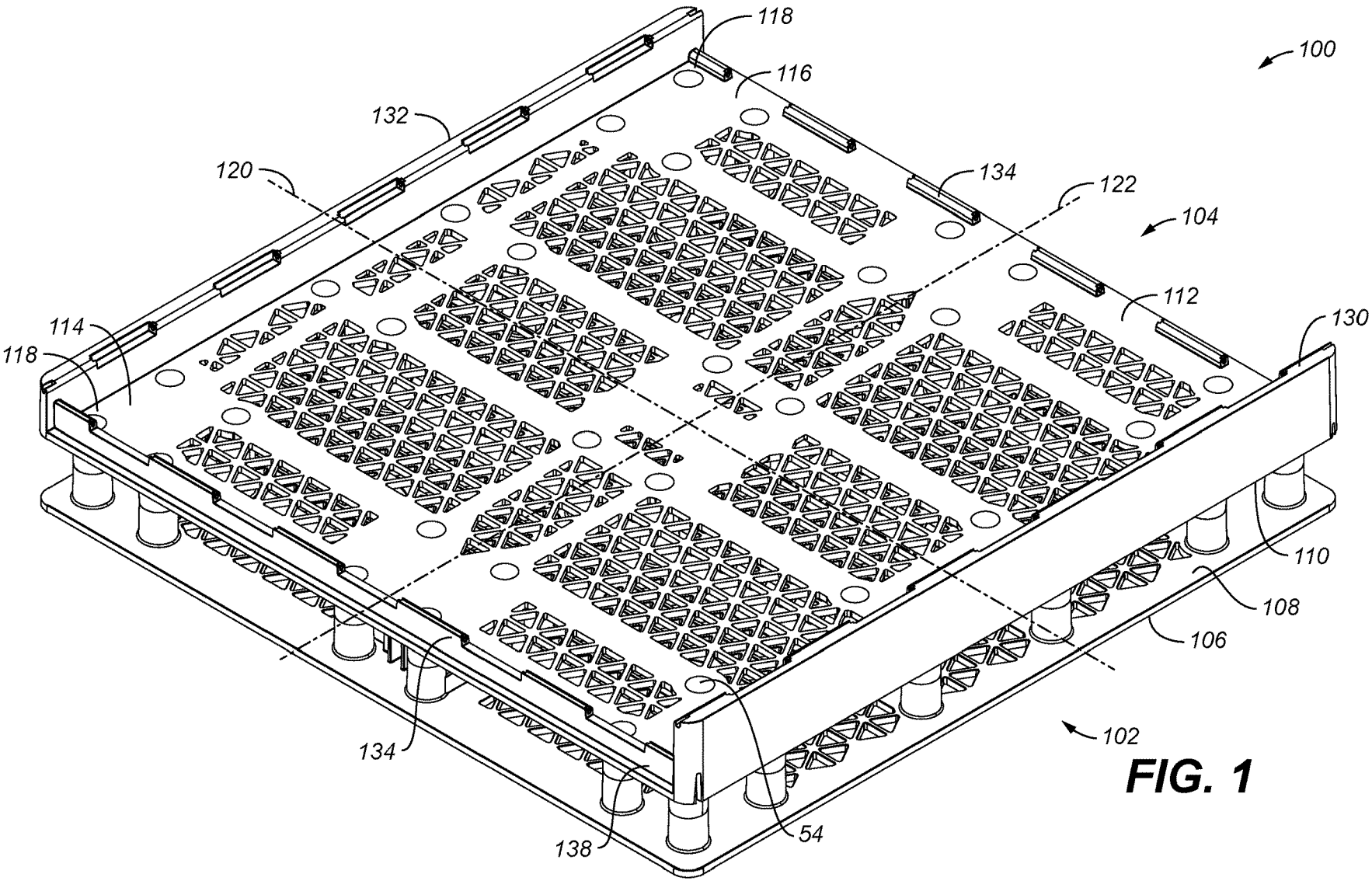
FIG. 1 depicts a top right perspective view of the pallet top portion 104 and pallet bottom portion 102 for an embodiment of the trackable nylon pallet and collapsible container 12.

Embodiments of the nylon pallet and collapsible container 12 provide a rigid, injection molded nylon pallet bottom portion 102 including a bottom portion planar bottom side 106 and a bottom portion top side 108, FIGS. 1-4.

Embodiments of the nylon pallet and collapsible container 12 nylon pallet bottom portion 102 include four equal length pallet sides, two length sides 114, and two width sides 116, and four ninety-degree corners 118, FIGS. 1-4.

Figure 2:
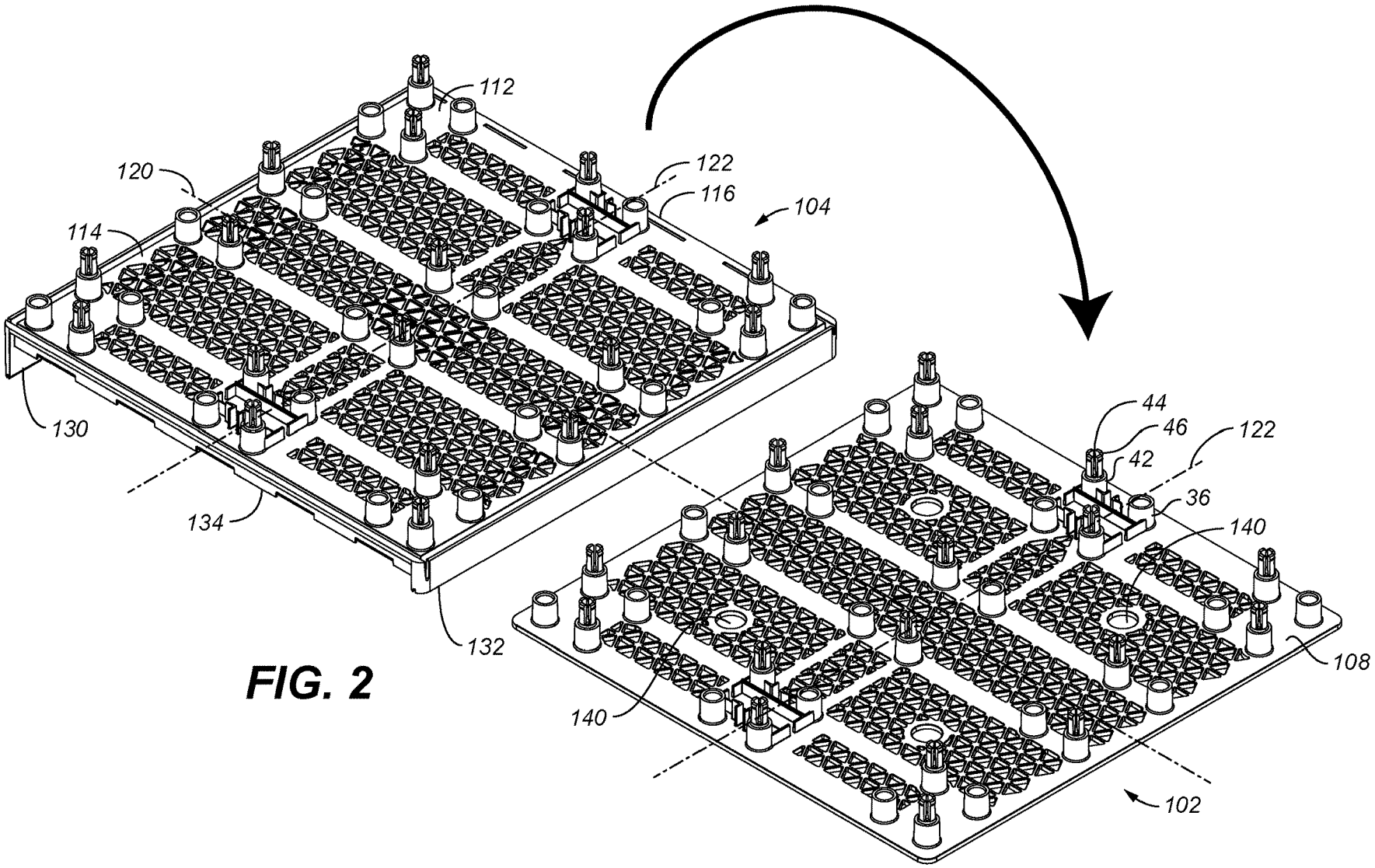
FIG. 2 depicts top right perspective views of the pallet top portion 104 and pallet bottom potion 102 of FIG. 1 before the top and bottom portions are connected.
Figure 3:
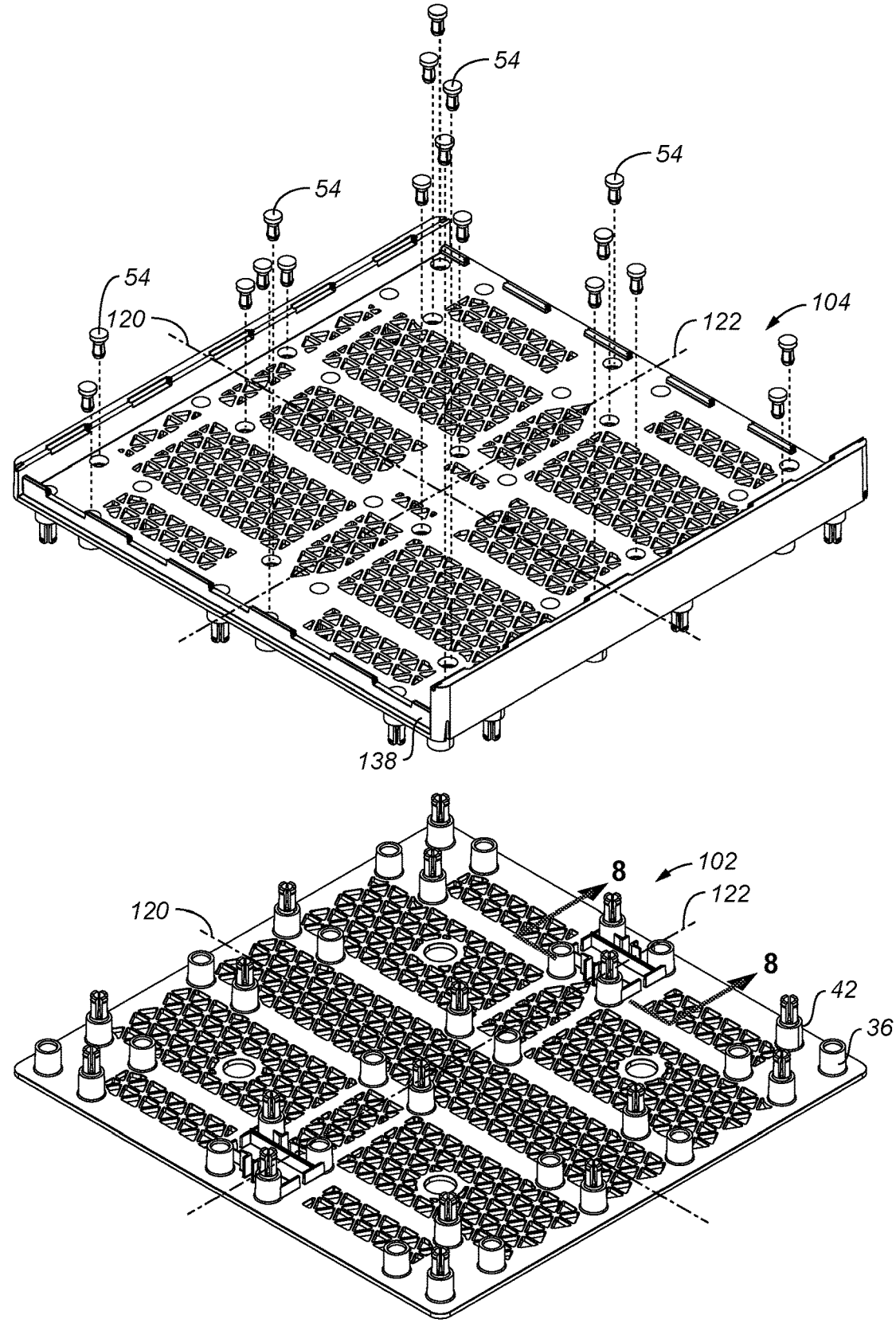
FIG. 3 depicts top right perspective exploded views of the alignment of pallet top portion 104 and pallet bottom portion 102 of the trackable nylon pallet and collapsible container of FIG. 1 before the pallet top portion 104 and the pallet bottom portion 102 are connected.

Embodiments of the nylon pallet and collapsible container 12 nylon pallet bottom portion 102 provide a plurality of equal sized upstanding nylon posts affixed to the bottom portion top side 108 in four equal sized arrays of four upstanding nylon posts in the four corners 118 of the bottom portion top side 108, three equal sized arrays of four upstanding nylon posts along a central axis 120 of the pallet length sides 114 with two equal sized arrays near the center portion of each pallet length side 114 and the third equal array centered between the two equal sized arrays near the center portion of each length side 114 in the center of the bottom portion top side 108, FIG. 2, and two equal sized arrays of four upstanding nylon posts along a central axis 122 of the pallet width sides 116 with one array near the center portion of each width side 116, FIGS. 1-3. For these embodiments, each array of four upstanding nylon posts includes two diagonally disposed upstanding nylon posts further comprising extended nylon attachment clips 42 and two diagonally opposed upstanding nylon posts comprising an open end sized to receive an attachment clip 36, FIG. 8.

Embodiments of the nylon pallet and collapsible container 12 nylon pallet bottom portion 102 include two equal sized arrays of four upstanding nylon posts along a central axis 122, respectively, of the pallet width sides 116, respectively, further include at least one such array providing equal sized nylon frame sides 68 and 70 between upstanding nylon posts 36 and 42, the frame sides 68 and 70 orthogonally disposed to the central axis 122 of the pallet width sides 116, FIGS. 1-4.

Embodiments of the trackable nylon pallet and collapsible container nylon pallet top portion 104 include a plurality of equal sized upstanding nylon posts affixed to the top portion bottom side 112 in four equal sized arrays of four upstanding nylon posts in the four corners 118 of the top portion bottom side 112, three equal sized arrays of four upstanding nylon posts along a central axis 120 of the pallet length sides 114 with two equal sized arrays each near the center portion of each separate pallet length side 114 edge and the third equal array centered between the two arrays in the center of each separate pallet length side 114 in the center of the top portion bottom side 112, and two equal sized arrays of four upstanding nylon posts along a central axis of the pallet width sides 116 with each array near the center portion of each pallet width side 116 edge, FIGS. 1-4. For these embodiments, each array of four upstanding nylon posts includes two diagonally disposed upstanding nylon posts each with an extended nylon attachment clip 42 and two diagonally opposed upstanding nylon posts each providing an open end 36 sized to receive and hold a post with the extended nylon attachment clip, FIGS. 2, 3, and 8. Embodiments of the trackable nylon pallet and collapsible container nylon pallet top portion top side 110 provide a first upstanding side 130 defining a planar height above the planar top side 110 and an opposite a second upstanding side 132 defining a lower planar height than that of the first upstanding side 130 above the planar top side 110, a third upstanding side 138 between the first upstanding side 130 and the second upstanding side 132 defining a lower planar height than that of the second upstanding side 132, and equal sized alternating insertion and projection portions 134 along the first, second, and third upstanding sides, 130,132, and 138 respectively, and the other top side, and orthogonal apertures 146 or 148 on each first, second and third upstanding side, 130, 132, and 138 respectively, end sized to receive and hold a hinge rod 154, FIGS. 1, 3, 5, 6, 10, 17 and 18.

Embodiments of the trackable nylon pallet and collapsible container pallet top portions 104 and nylon pallet bottom portions 102, FIGS. 1-4, include mirror image arrays of equal sized upstanding nylon posts each providing an extended nylon attachment clip 42 and equal sized upstanding nylon posts each including an open end 36 sized to receive and hold an upstanding nylon post providing an extended attachment clip 42. When the nylon pellet top portion 104 bottom side 112 arrays of upstanding nylon posts are fitted onto arrays of upstanding nylon posts in a corresponding nylon pallet bottom portion 102 top side 108 each respective upstanding nylon post open end 36 receives and holds a corresponding upstanding nylon post providing an extended nylon attachment clip 42, FIGS. 2, 3, and 8. A nylon locking pin 54, secures and locks each upstanding extended nylon attachment clip 42 into its corresponding upstanding nylon post open end, FIGS. 3 and 8, from the nylon pallet bottom portion planar bottom side 106 and the nylon pallet top portion planar top side 110. It is understood by person having skill in the art that the nylon locking pin 54 is attached from both the top portion planar top surface, FIG. 3, and the bottom portion planar bottom surface (not shown) to each pairing of an upstanding nylon post further comprising an extended nylon attachment clip 42 and an upstanding nylon post comprising an open end sized to receive an attachment clip 36 for all embodiments of the trackable nylon pallet and collapsible pallet, FIGS. 3 and 8.

Figure 4:
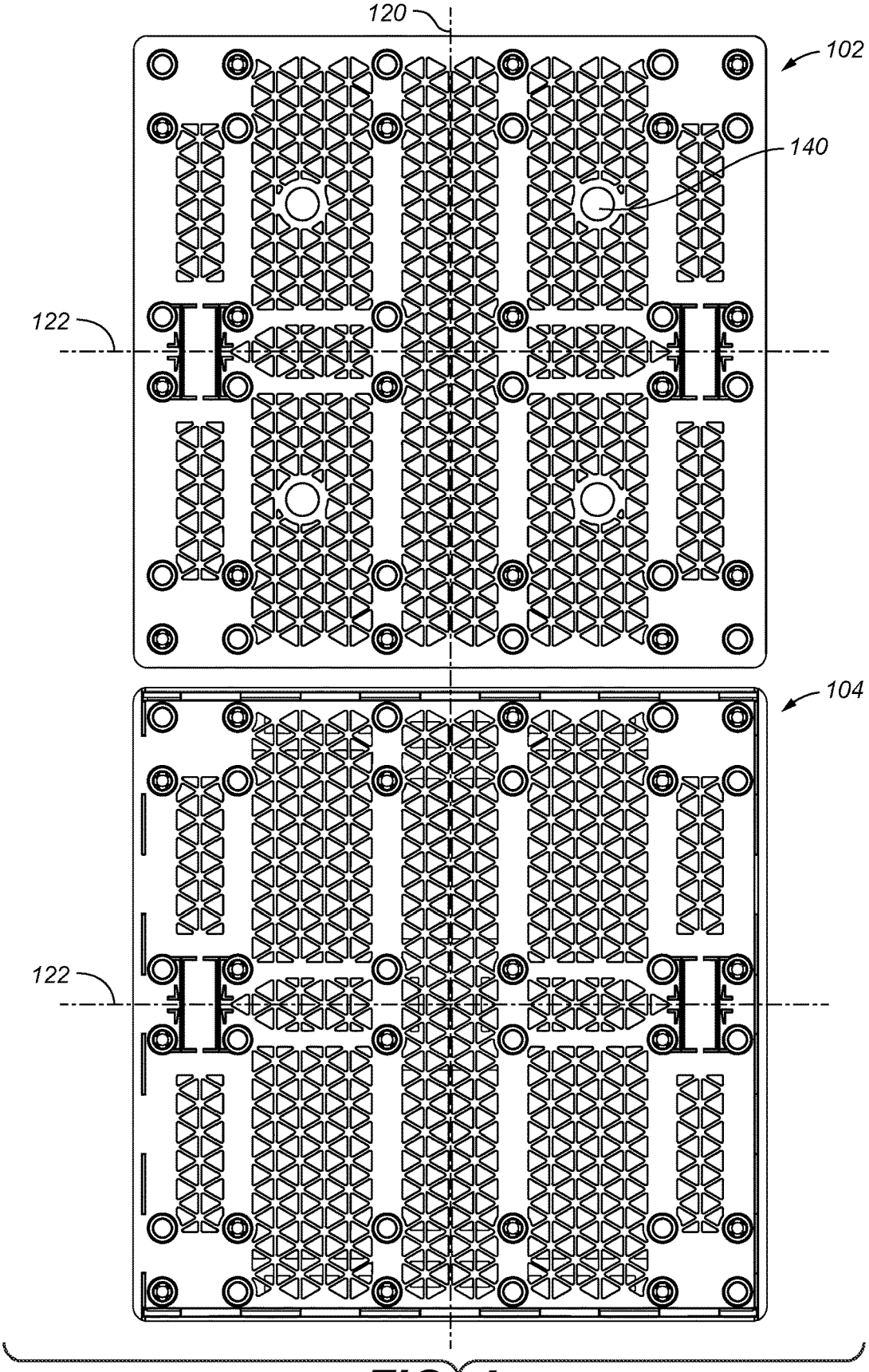
FIG. 4 depicts plan top view of the pallet bottom portion 102 top side 108 and a bottom plan view of the pallet top portion 104 bottom side 112 of FIG. 1.

Embodiments of the trackable nylon pallet and collapsible container nylon pallet top portion bottom side 112 including two equal sized arrays of four upstanding nylon posts along a central axis of the top portion width sides 122, FIG. 4, further include at least one such array providing equal sized nylon frame sides 68 and 70 between upstanding nylon posts corresponding to the equal sized frame sides 64 and 66 between upstanding nylon posts of the bottom portion top side 108 and the frame sides orthogonally disposed to the central axis of the top portion width sides 122 respectively FIGS. 2 and 3.

Embodiments of the nylon pallet and collapsible container 12 include a first collapsible side 162, FIGS. 5-7D, that provides a bottom side length including alternating insertion and projection portions 136 with affixed hinge barrels 152 corresponding to the alternating insertion and projection portions 134 of the pallet planar top side defining a common longitudinal channel sized to receive a hinge rod 154, FIGS. 1, 3, 5, and 6. The first collapsible side 162 height is sized to provide a common collapsible box height when all four collapsible sides connected to the pallet planar top side 110 are positioned orthogonally to the pallet planar top side 110, FIGS. 5 and 6. A hinge rod sized to be received into the common longitudinal channel between the first collapsible side bottom side and affixed hinge barrels 152 and the common longitudinal channel of the pallet planar top side connects the first collapsible side 162 to the pallet planar top side and allows the first collapsible side 162 to fold inward towards the pallet planar top side when the collapsible box of the trackable nylon pallet and collapsible container is not in use, FIGS. 7A-7B.

Embodiments of the nylon pallet and collapsible container 12 include a second collapsible side 164, FIGS. 5-7D, that provides a bottom side length including alternating insertion and projection portions 136 with affixed hinge barrels 152 corresponding to the alternating insertion and projection portions 134 of the pallet planar top side defining a common longitudinal channel sized to receive a hinge rod 154, FIGS. 1, 3, 5, and 6. The second collapsible side 164 height is sized to provide a common collapsible box height when all four collapsible sides connected to the pallet planar top side 110 are positioned orthogonally to the pallet planar top side 110, FIGS. 5 and 6. A hinge rod sized to be received into the common longitudinal channel between the first collapsible side bottom side and affixed hinge barrels 152 and the common longitudinal channel of the pallet planar top third upstanding side 138 connects the second collapsible side 164 to the pallet planar top side and allows the second collapsible side 164 to fold inward towards the pallet planar top side when the collapsible box of the trackable nylon pallet and collapsible container is not in use, FIGS. 7A-7B.

Embodiments of the nylon pallet and collapsible container 12 include a third collapsible side 166, FIGS. 5-7D, that provides a bottom side length including alternating insertion and projection portions 136 with affixed hinge barrels 152 corresponding to the alternating insertion and projection portions 134 of the pallet planar top second upstanding side 132 defining a common longitudinal channel sized to receive a hinge rod 154, FIGS. 1, 3, 5, and 6. The third collapsible side 166 height is sized to provide a common collapsible box height when all four collapsible sides connected to the pallet planar top side 110 are positioned orthogonally to the pallet planar top side 110, FIGS. 5 and 6. A hinge rod sized to be received into the common longitudinal channel between the first collapsible side bottom side and affixed hinge barrels 152 and the common longitudinal channel of the pallet planar top second upstanding side 132 connects the third collapsible side 166 to the pallet planar top side and allows the third collapsible side 166 to fold inward towards the pallet planar top side when the collapsible box of the trackable nylon pallet and collapsible container is not in use, FIG. 7C.

Embodiments of the nylon pallet and collapsible container 12 include a fourth collapsible side 168, FIGS. 5-7D, that provides a bottom side length including alternating insertion and projection portions 136 with affixed hinge barrels 152 corresponding to the alternating insertion and projection portions 134 of the pallet planar top first upstanding side 130 defining a common longitudinal channel sized to receive a hinge rod 154, FIGS. 1, 3, 5, and 6. The fourth collapsible side 168 height is sized to provide a common collapsible box height when all four collapsible sides connected to the pallet planar top side 110 are positioned orthogonally to the pallet planar top side 110, FIGS. 5 and 6. A hinge rod sized to be received into the common longitudinal channel between the first collapsible side bottom side and affixed hinge barrels 152 and the common longitudinal channel of the pallet planar top first upstanding side 130 connects the fourth collapsible side 168 to the pallet planar top side and allows the fourth collapsible side 168 to fold inward towards the pallet planar top side when the collapsible box of the trackable nylon pallet and collapsible container is not in use, FIG. 7D.

Figure 5:
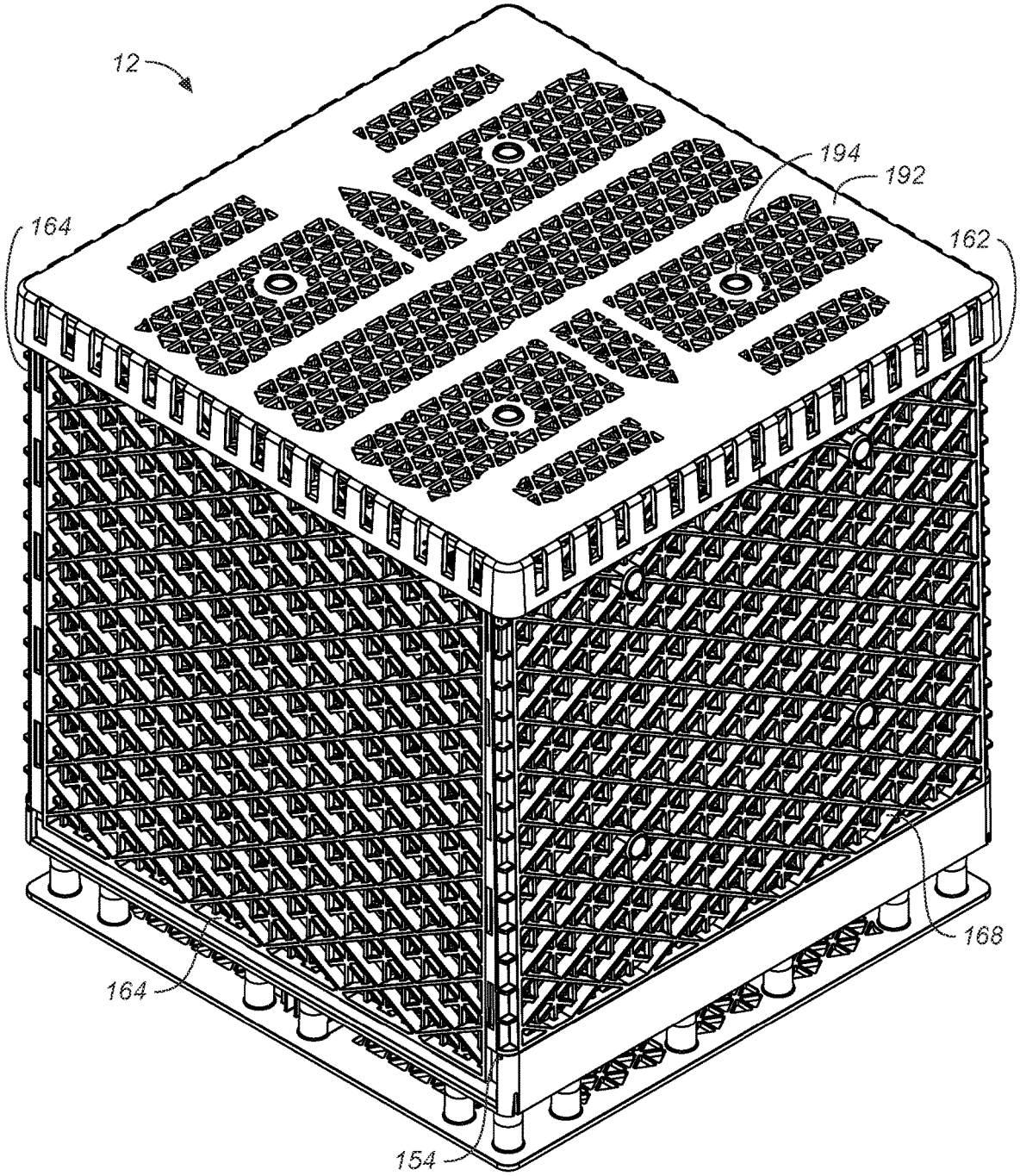
FIG. 5 is a top left perspective view of an embodiment of the trackable nylon pallet and collapsible container 12.
Figure 6:
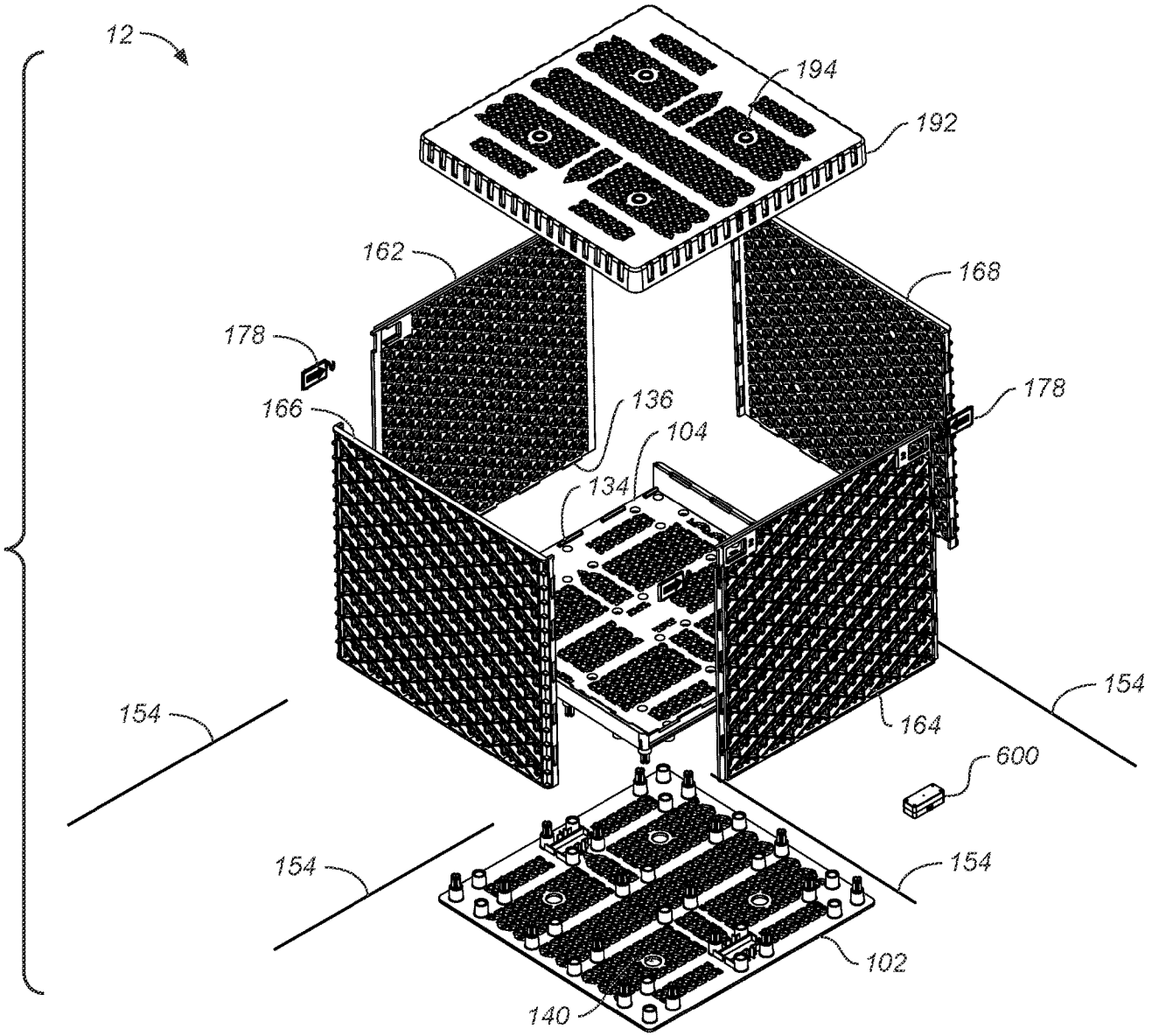
FIG. 6 is an exploded view of FIG. 5, after rotating FIG. 5 ninety (90°) degrees counterclockwise through a central longitudinal vertical axis (not depicted).
Figure 7A:
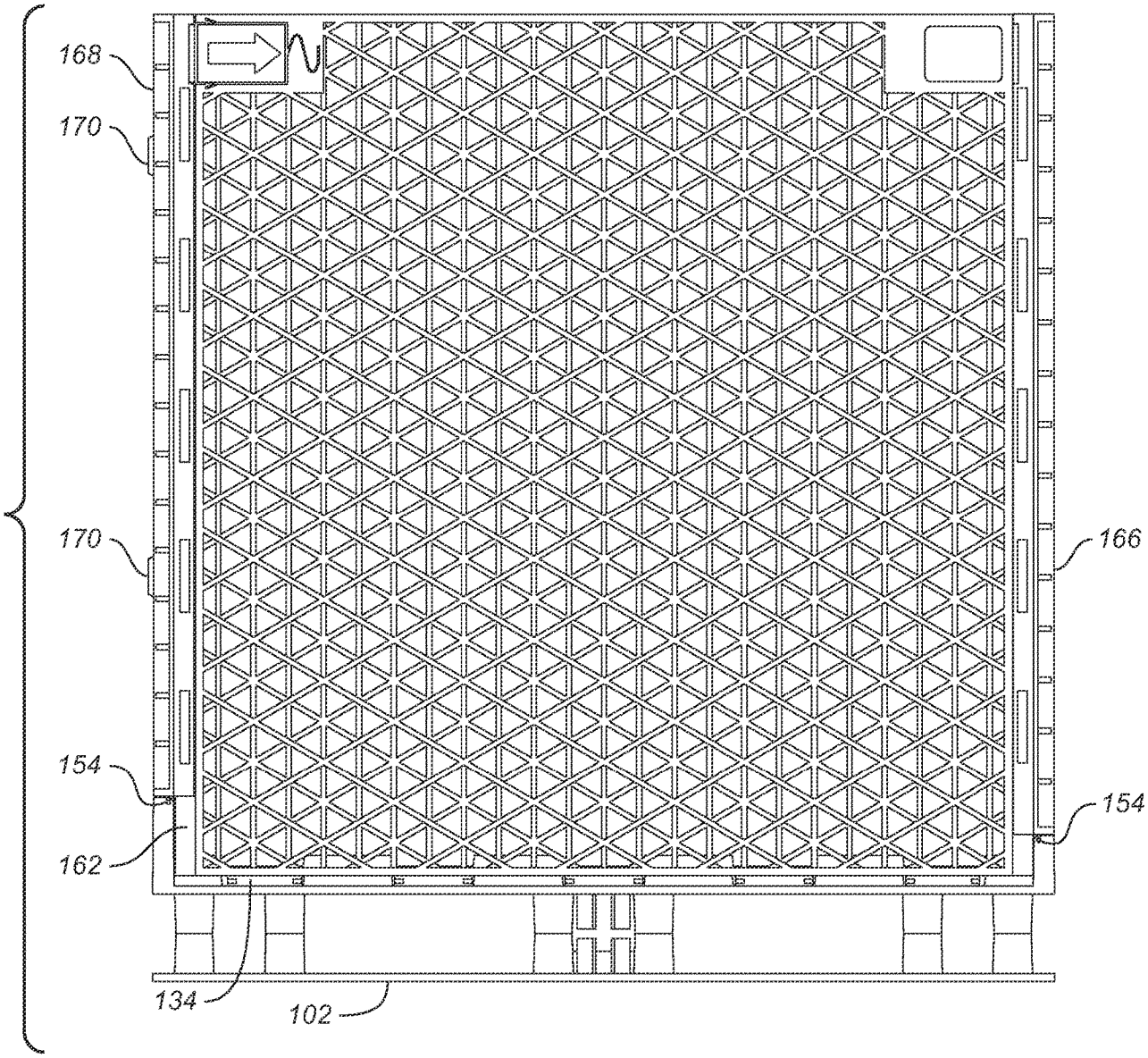
FIG. 7A is an elevational view of a first collapsible container side 162 for an embodiment of the trackable nylon pallet and collapsible container 12.
Figure 7B:
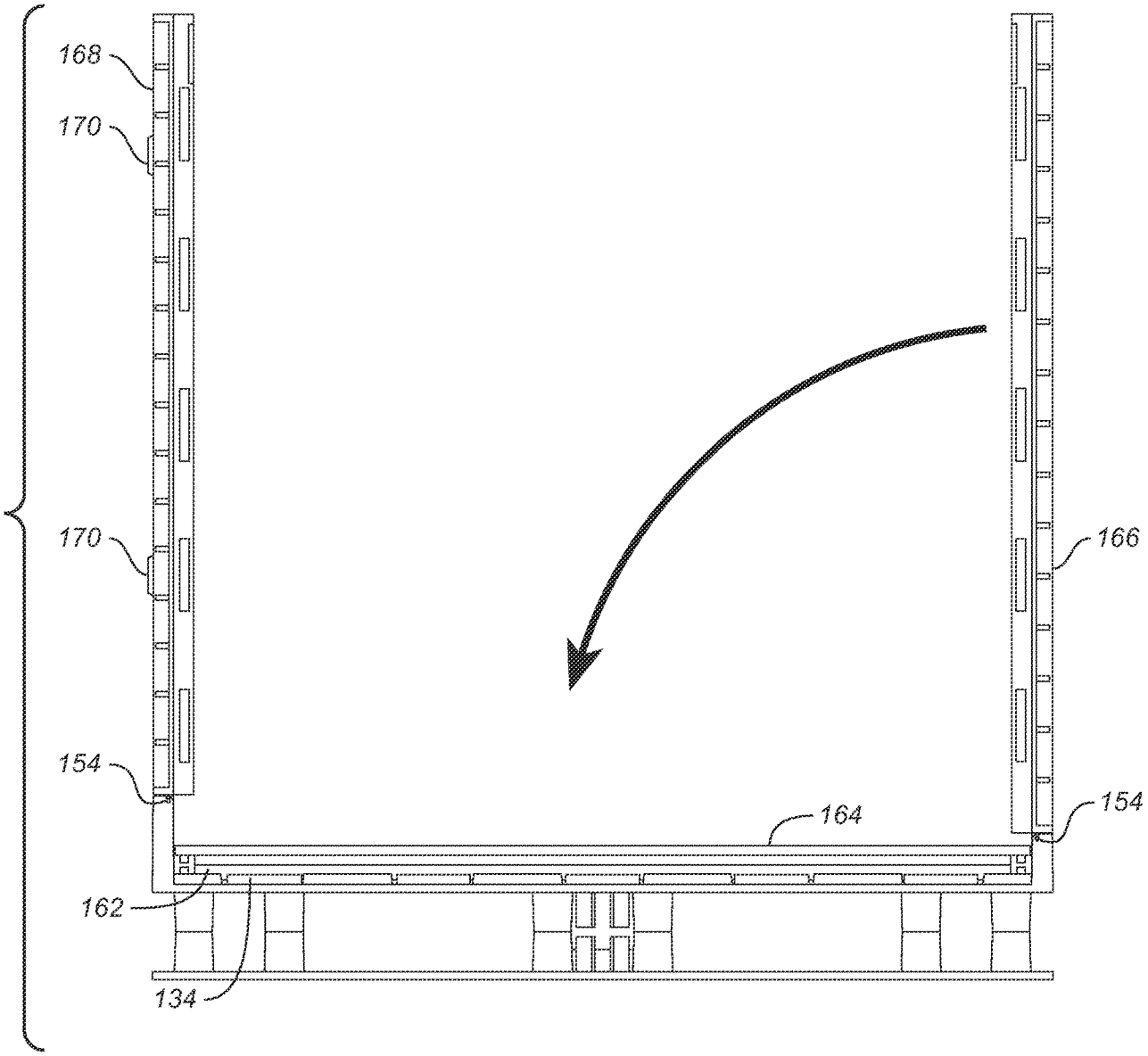
FIG. 7B is an elevational view of FIG. 7A depicting a first collapsible container side 162 folded down onto the pallet top portion 104 with a second collapsible container side 164 folded over the first collapsible container side 162, and a third collapsible container side 166 prepared to be folded down onto the second collapsible container side 164.
Figure 7C:
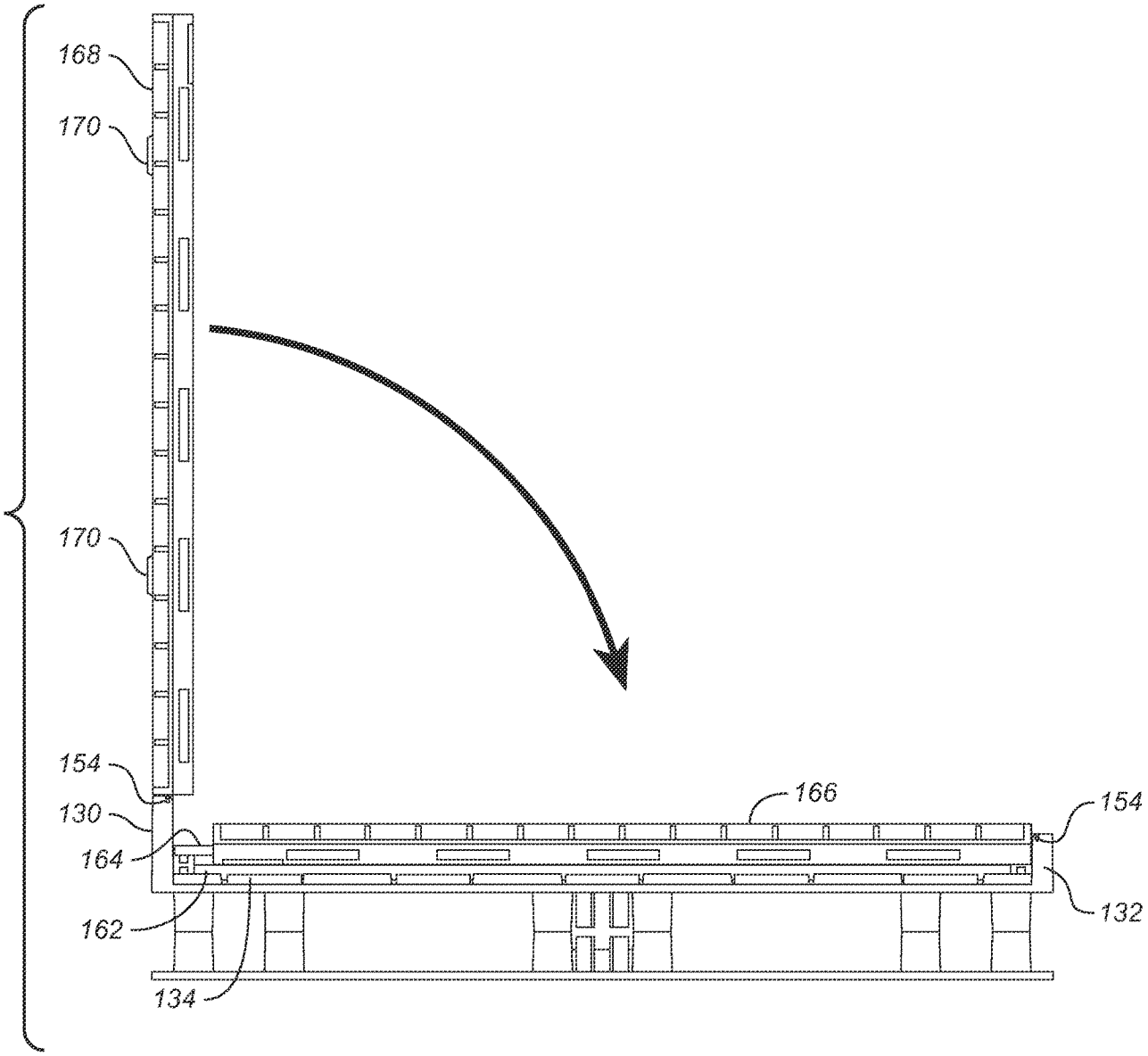
FIG. 7C is an elevational view of FIG. 7B with the first, second, and third collapsible container sides (162, 164, and 166, respectively) folded down onto the pallet top portion 104, and a fourth collapsible container side 168 prepared to be folded down onto the third collapsible container side 166.
Figure 7D:
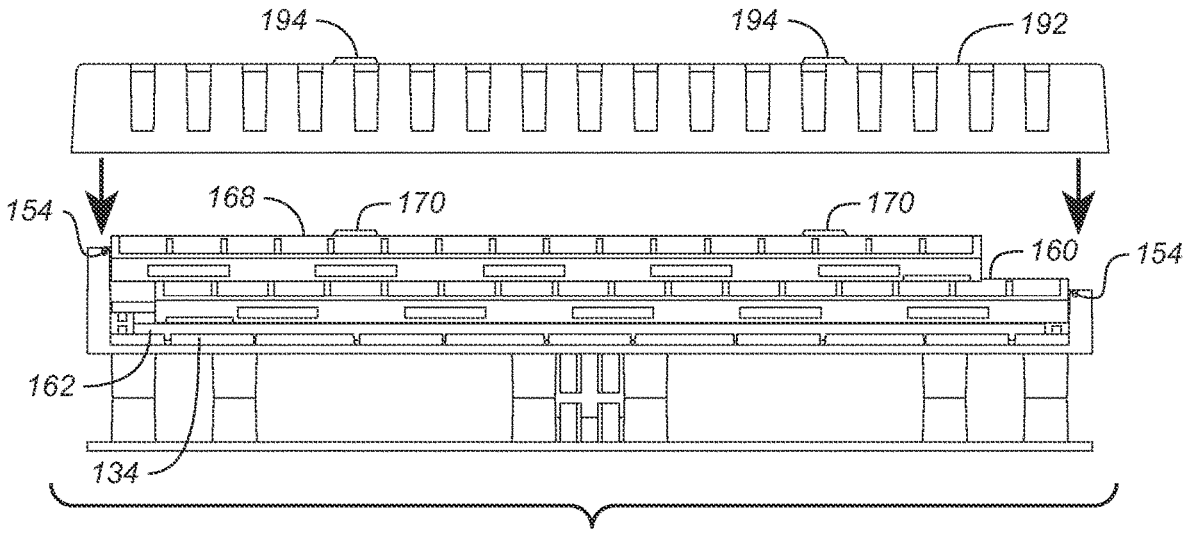
FIG. 7D is an elevational view of FIG. 7C with all four collapsible container sides collapsed onto the pallet top portion and a collapsible container cover 192 positioned to fit over the collapsed sides.
Figure 7E:
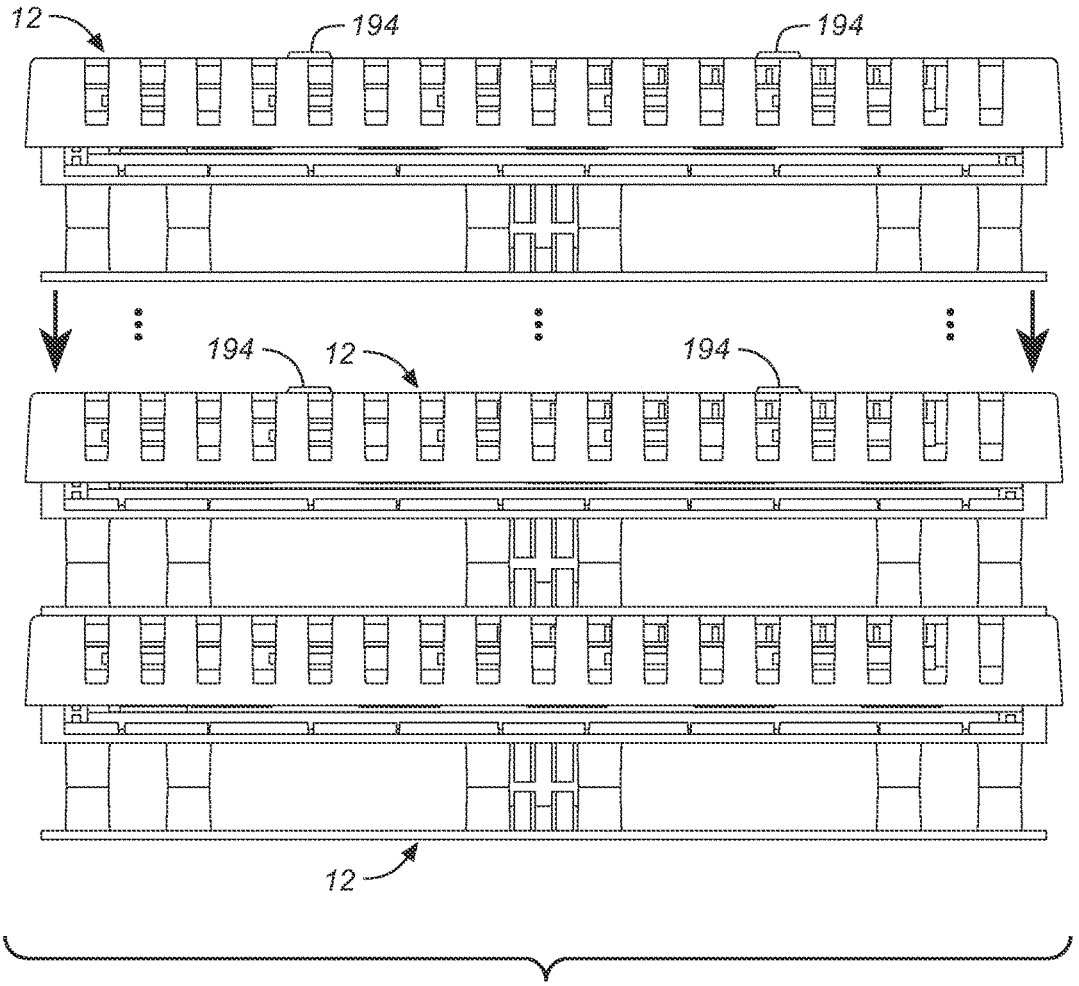
FIG. 7E an elevational view of three trackable nylon pallet and collapsible containers 12 with covers 192 stacked one upon another.

Embodiments of the nylon pallet and collapsible container 12 include a top cover 192 extending down from four collapsible sides when extended to the common box height, FIGS. 5 and 6, or over the collapsible sides folded inwards and resting on the pallet planar top side 110 when the collapsible container of the trackable nylon pallet and collapsible container is not in use, FIGS. 7D and 7E. The top cover 192 includes four raised cylindrical stabilizers 194 which provide cylindrical indents on the underside of the top cover 192 positioned and sized to receive stabilizer detents 170 on the external surface of the fourth collapsible side, FIGS. 7A-7D, when the fourth collapsible side has been folded down onto the other three collapsible sides when the collapsible container is not in use. Each cylindrical stabilizer 194 is centered on a quadrant of the top cover, FIG. 5, and as such are also positioned and sized to be received by cylindrical openings 140 on the pallet bottom portion 102, FIGS. 2, 4 and 6, providing stability to the stacking of trackable nylon pallet and collapsible containers 12 when all four collapsible sides are folded inwards on top of the pallet top side 110, 7E.

Figure 11:
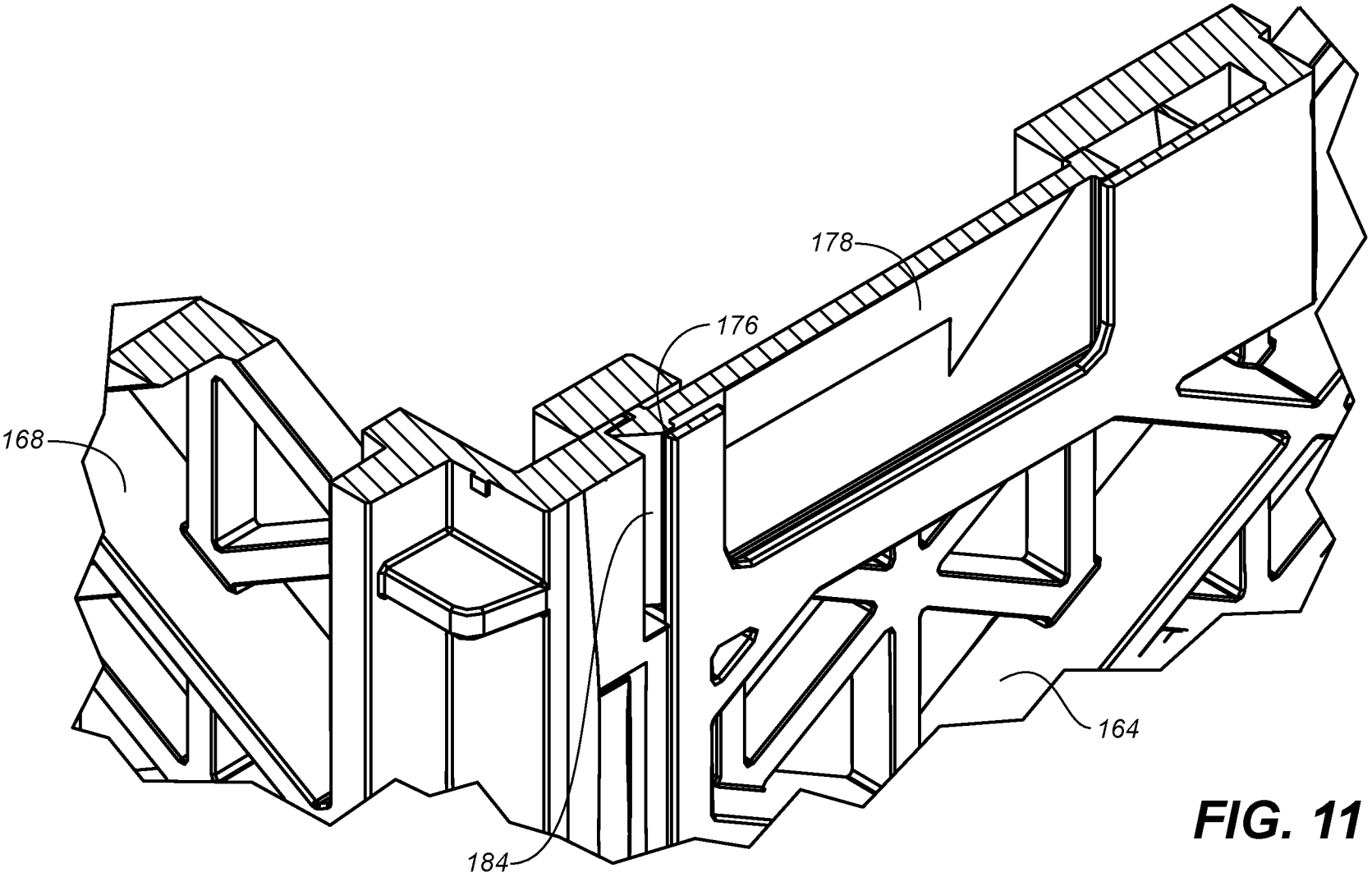
FIG. 11 depicts a detailed perspective view of a side latch assembly 176 connection of the top of a second collapsible container side 164 to the top of a fourth collapsible container side 168 for an embodiment of the trackable nylon pallet and collapsible container.
Figure 12:
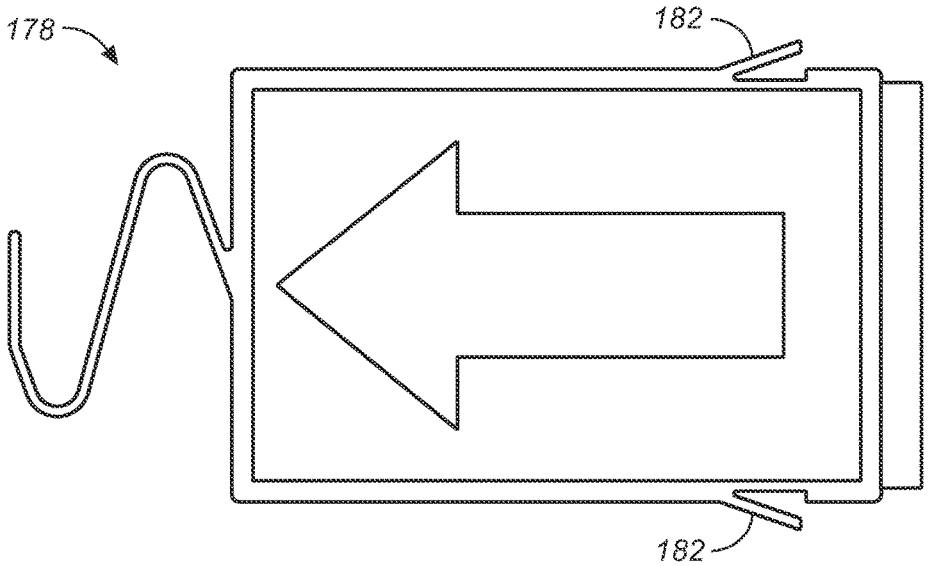
FIG. 12 is an elevational front view of the latch 178 of the side latch assembly 176 for an embodiment of the trackable nylon pallet and collapsible container.
Figure 13:
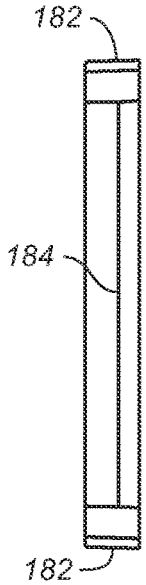
FIG. 13 is an elevational right-side view of FIG. 12.
Figure 14:
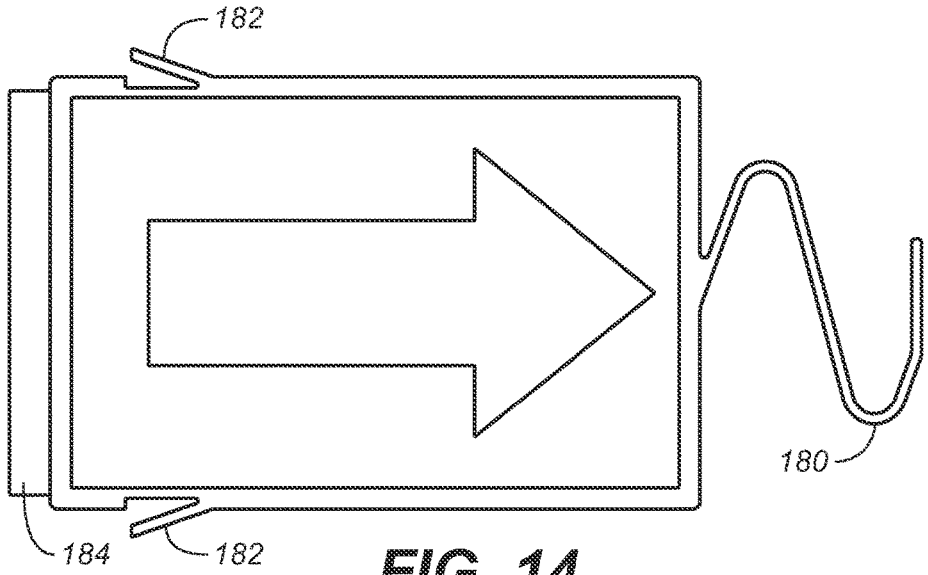
FIG. 14 is an elevational back view of FIG. 12.
Figure 15:
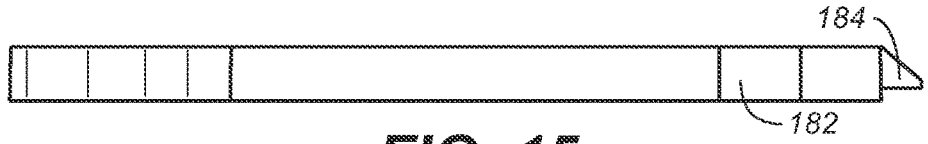
FIG. 15 is a planar bottom view of FIG. 12.
Figure 16A:
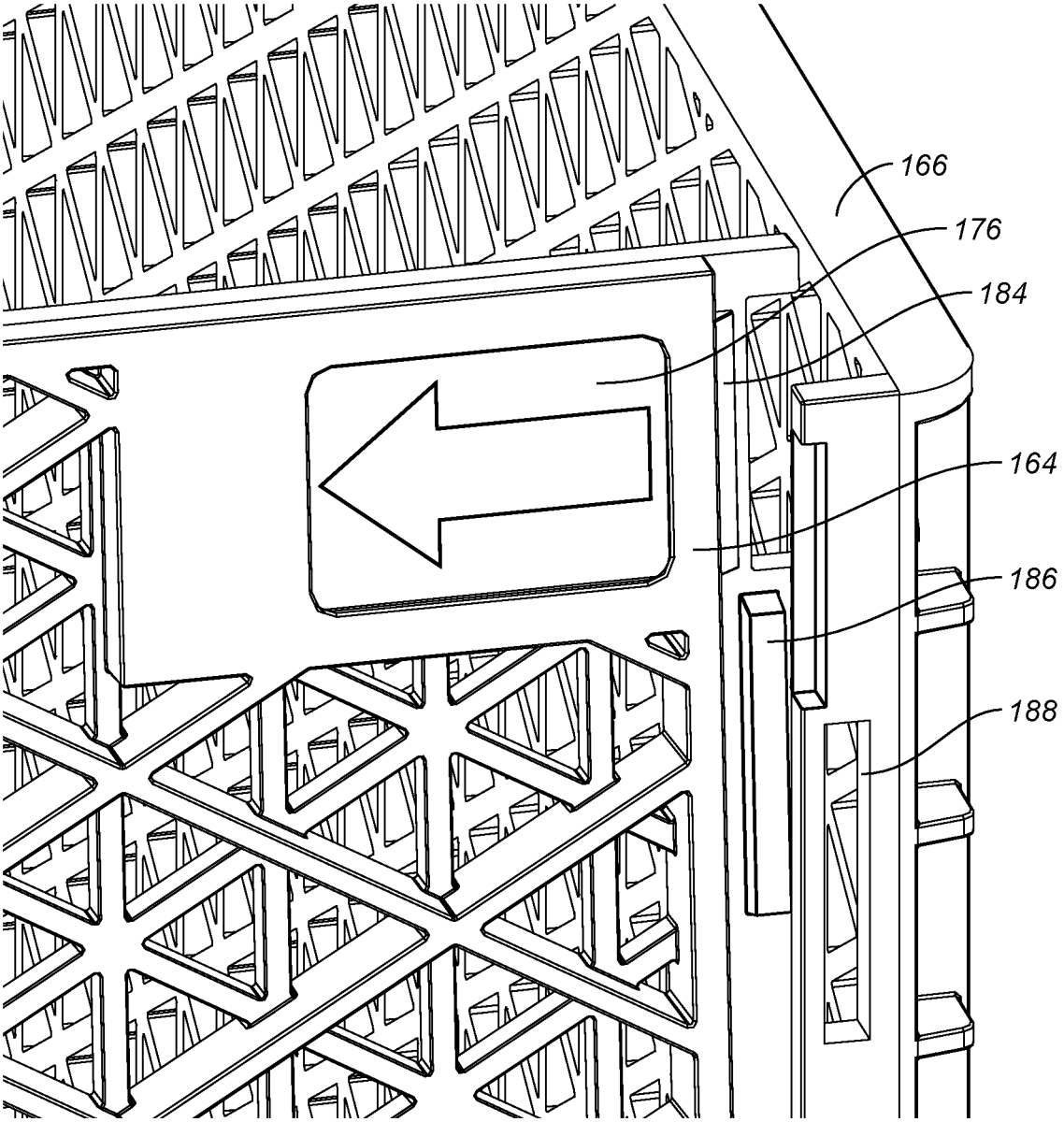
FIG. 16A is a detailed perspective view of the side latch assembly 176 of the top of the second collapsible container side 164 positioned to be locked into the top of the third collapsible container side 166 for an embodiment of the trackable nylon pallet and collapsible container 12.
Figure 16B:
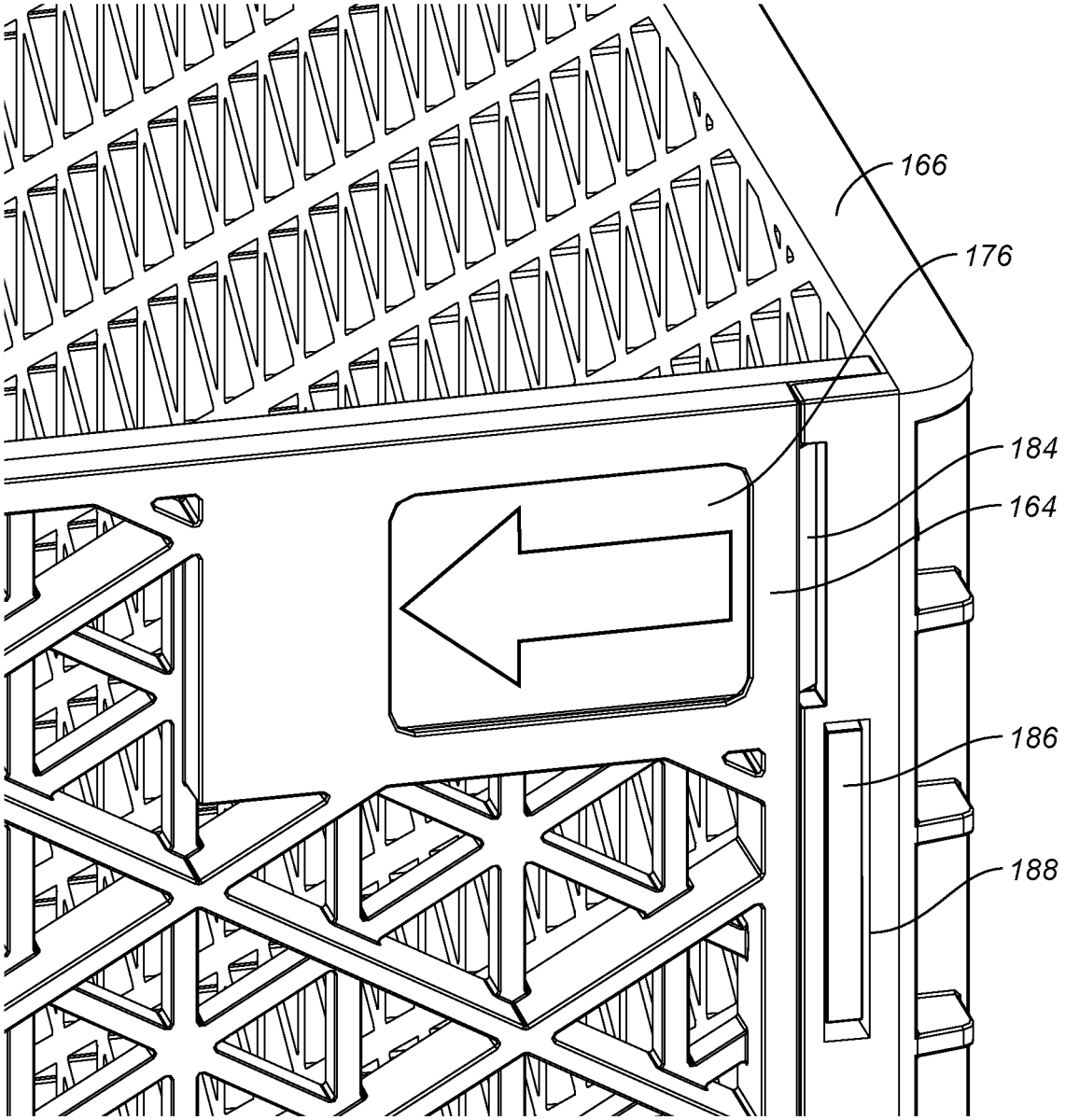
FIG. 16B a detailed perspective view of FIG. 16A with the side latch assembly 176 of the top of the second collapsible container side 164 locked into the top of the third collapsible container side 166.
Figure 17:
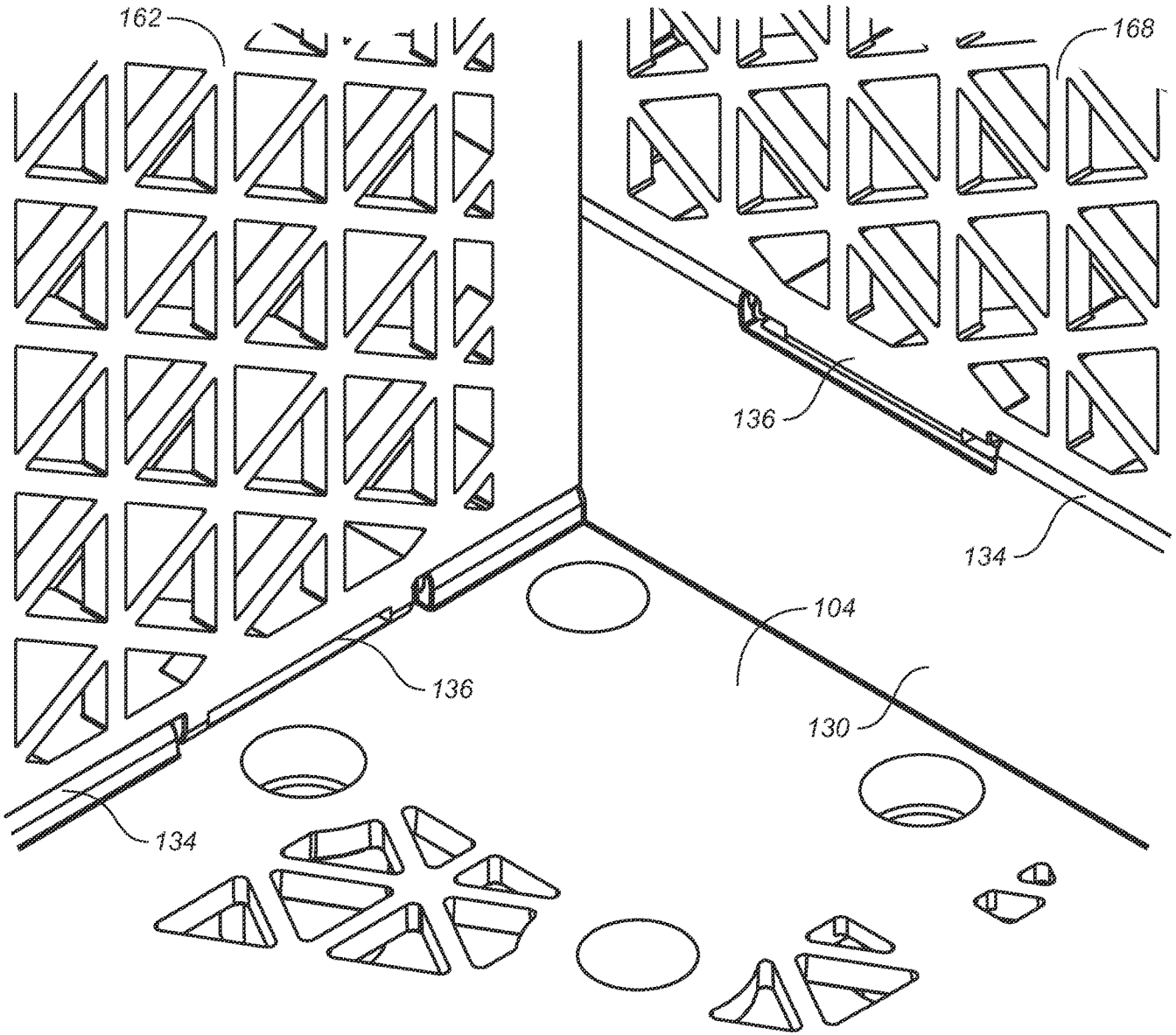
FIG. 17 is a detailed internal perspective view of the interconnecting fourth collapsible container side 168 alternating insertion and projecting portions 136 with pallet top portion alternating insertion and projecting portions 134 between the top pallet portion second upstanding side 162 and the pallet portion first upstanding side 130 for an embodiment of the trackable nylon pallet and collapsible container 12.
Figure 18:
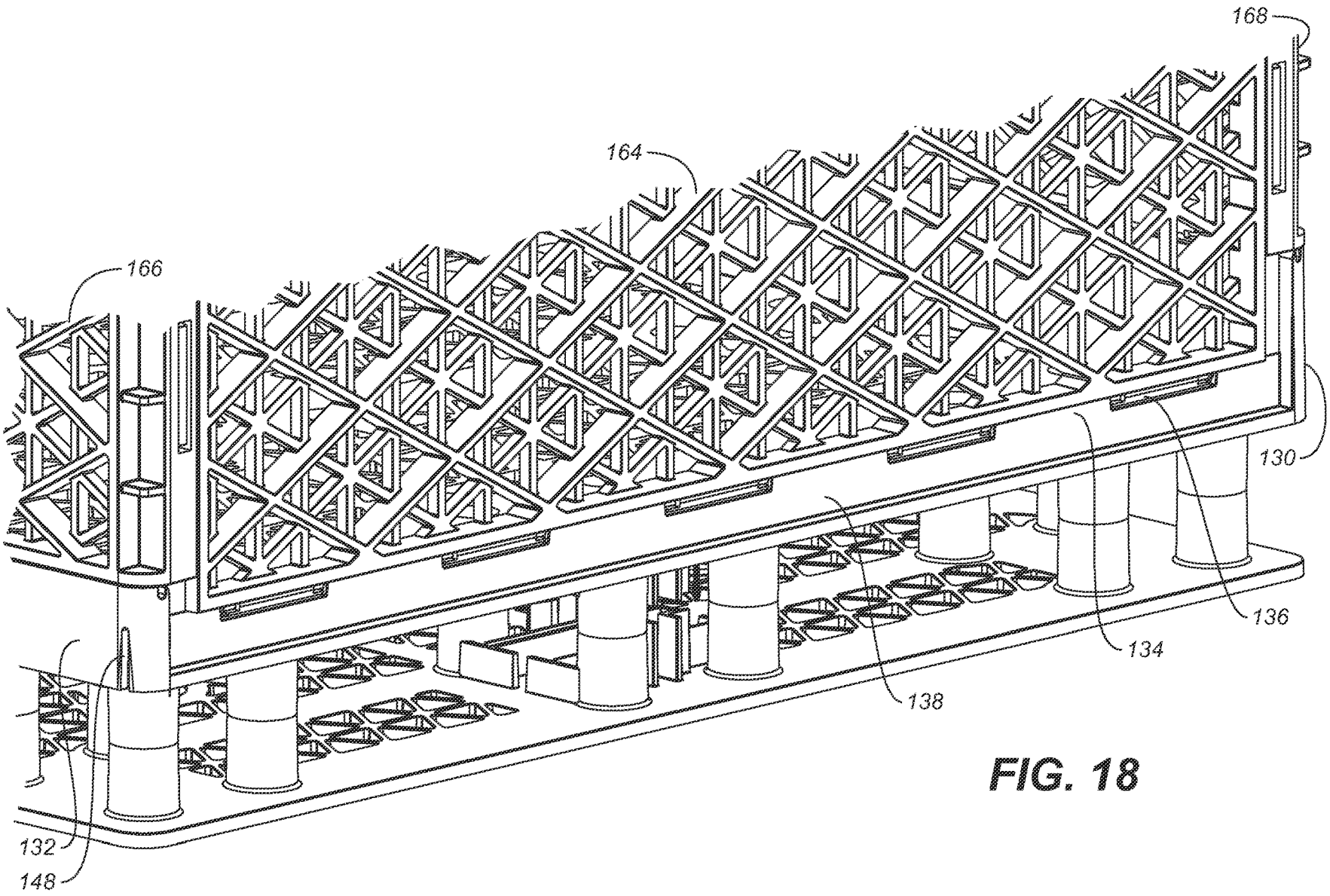
FIG. 18 is a detailed external perspective view of the interconnecting second collapsible container side 164 alternating insertion and projecting portions 136 with pallet top portion third upstanding side 138 alternating insertion and projecting portions 134 between the pallet portion third and fourth upstanding sides, 166 and 168 respectively, for an embodiment of the trackable nylon pallet and collapsible container 12.

Embodiments of the nylon pallet and collapsible container 12 include first and second collapsible sides, 162 and 164 respectively, top locking side latch assemblies 176 to releasably engage the top corners of adjacent third and fourth collapsible sides, 166 and 168 respectively, when the when the collapsible box of the trackable nylon pallet and collapsible container 12 is in use. Embodiments of the top locking side latch assemblies 176 provide a latch 178, an attached resilient elastic return member 180, latch locking clips 182, and a latch tapered head 184, FIGS. 11-16B. Latch 178 is slidably positioned in upper and lower tracks in the two top corners of the first and second collapsible sides, 162 and 164 respectively, FIGS. 6, 7A, and 11 with the attached resilient return member 180 affixed to first and second collapsible sides track ends. As the first and second collapsible sides, 162 and 164 respectively, are positioned between the top corners of adjacent third and fourth collapsible sides, 166 and 168 respectively, the latch tapered head 184 engages a corner of the respective adjacent third or fourth collapsible sides, 166 and 168 respectively, and the locking clips 182 engage slots in the track that releasably hold the latch in a connected position to the respective adjacent third or fourth collapsible sides, 166 and 168 respectively to prevent inward movement of all collapsible sides. Outward movement of all collapsible sides is prevented by engagement of first and second collapsible side fittings 186 received and housed within respective third and fourth collapsible side openings 188, FIGS. 16A and 16B. Outward movement of all collapsible sides is also provided by the cover 192 extending over the tops of the collapsible sides, FIG. 5, when the collapsible sides are orthogonally positioned regarding the pallet top side 110, FIGS. 1, 5, 6, and 7A, for use. When the collapsible sides are to be folded inwards to rest on the pallet top surface 110, the latch locking clips 182 are released by shifting the latch 178 upwards and downwards within the track slots, and the resilient lock return element 180 moves the latch tapered head 184 from the corner of the respective adjacent third or fourth collapsible sides, 166 or 168, and the respective first and second collapsible side fittings 186 are disengaged from the respective adjacent respective third and fourth collapsible side openings 188, FIGS. 7B-7E, and 9-16B.

Embodiments of the nylon pallet and collapsible container 12 include metal hinge rods 154 secured within their respective channel by at least one hinge barrel 152 within the channel. Hinge rods 152 for the first and second collapsible sides, 162 and 164 respectively, are further held within transverse channels within a pallet top side first upstanding side 130, and the pallet top side second upstanding side 132, FIGS. 1, 3, 5-7D, and 10 (for the first upstanding side 130). Hinge rods 152 for the third and fourth collapsible sides, 166 and 168 respectively, are further held within longitudinal channels on each end of the pallet top side first upstanding side 130 and a pallet top side second upstanding side 132, FIGS. 5-7D, and 10 (for the first upstanding side 130).

Embodiments of the nylon pallet and collapsible container 12 provide a rigid, injection molded nylon pallet top portion 104, an equal sized rigid, injection molded nylon pallet bottom portion 102, and rigid, injection molded upstanding nylon post open ends 36, upstanding nylon posts with extended attachment clip 42, nylon locking pins 54, nylon first second, third and fourth collapsible sides, 162-168, respectively, and the nylon collapsible sides cover 192, FIGS. 1-18.

All embodiments of the trackable nylon pallet and collapsible container 12 pallet include a plurality of connection and locking assembly points between the pallet bottom portion 102 and the pallet top portion 104. The connection and locking assembly points are grouped in arrays of four or two and each connection and locking assembly point provides one upstanding nylon post open end 36 receiving one upstanding nylon post with an extended nylon attachment clip 42 from a corresponding array from the top or bottom portion. The extended nylon attachment clip external lip 46 engages an upstanding nylon post open end internal groove 38 and the nylon attachment clip compression slots 44 hold the engagement of the upstanding nylon post with extended attachment clip 42 and the upstanding nylon post open end 36 in place. A nylon locking pin 54 is inserted into each nylon attachment clip compression slot 44 to allow the nylon locking pin body lip 60 to engage the internal attachment clip compression slot 44 and lock the nylon attachment clip compression slot 44 into the nylon upstanding nylon post open end internal groove 38, FIGS. 3 and 8.

Figure 8:
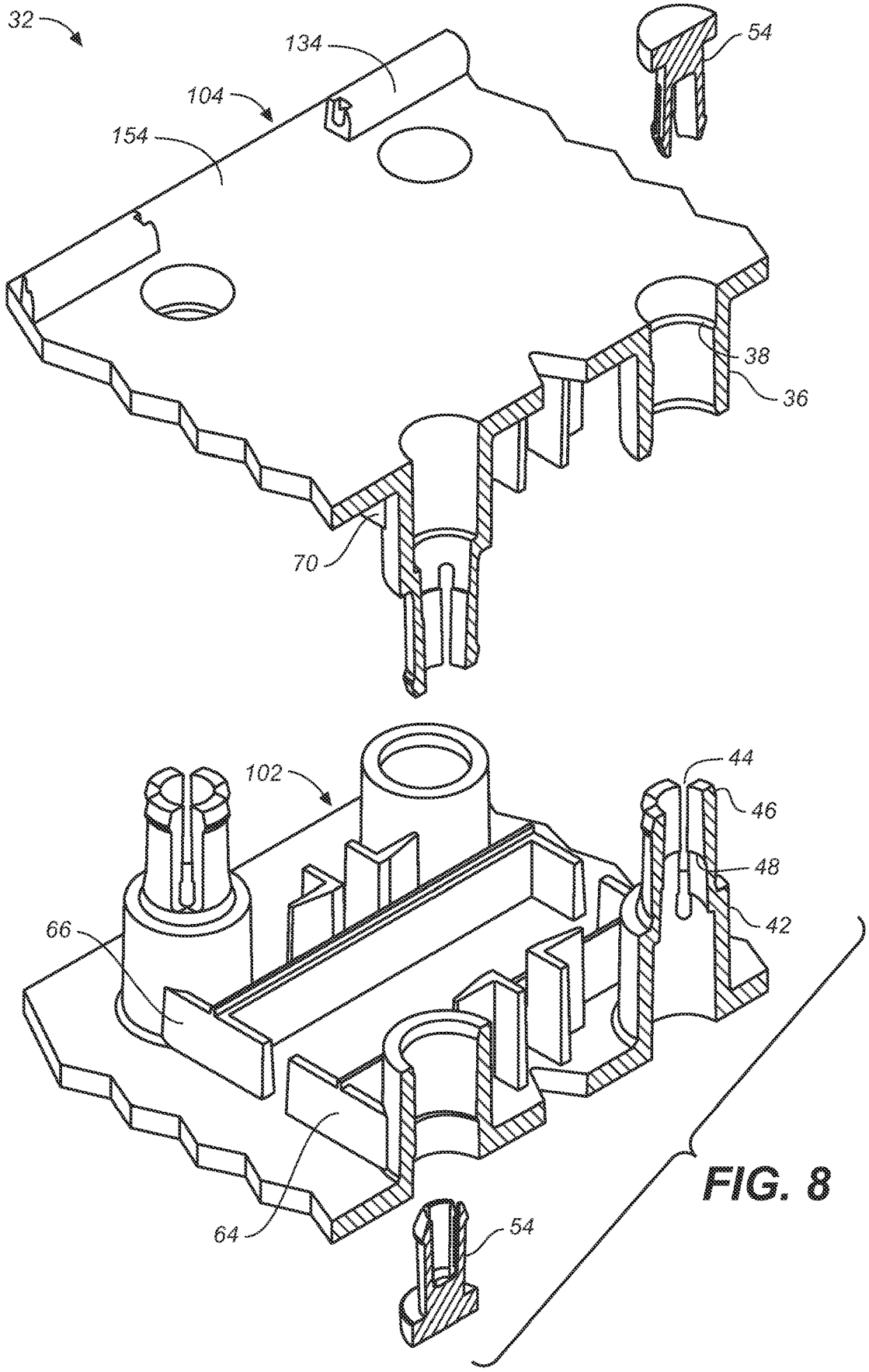
FIG. 8 depicts an exploded sectional view of interconnecting elements of the pallet top portion 104 and the pallet bottom portion 102 for FIG. 3 taken at "8-8."
Figure 9:
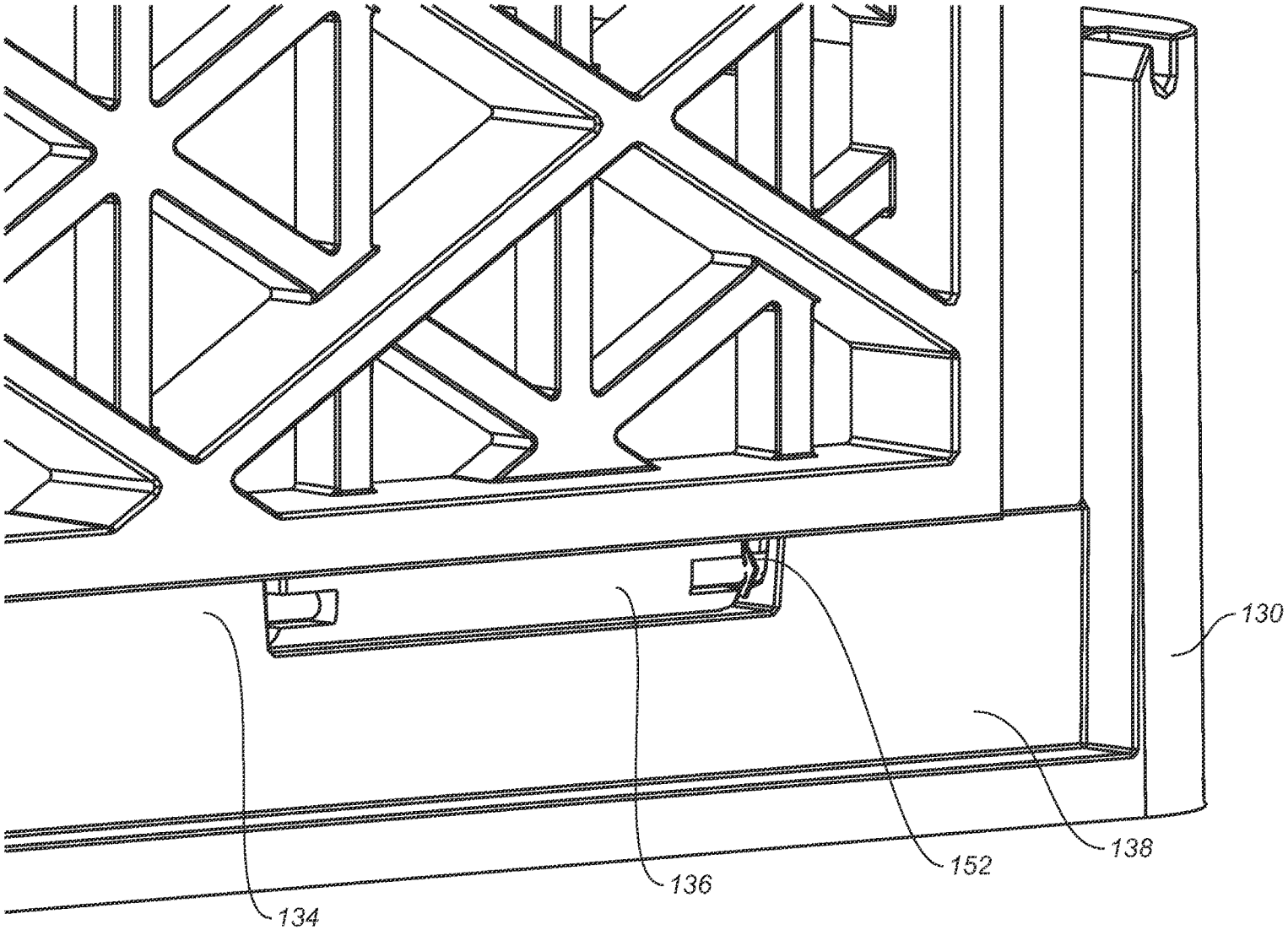
FIG. 9 depicts a detailed perspective view of the interconnection of pallet top side alternating insertion and projection portion 134 and a box side alternating insertion and projection portion 136 and connected hinge barrel 152 for an embodiment of the trackable nylon pallet and collapsible container.
Figure 10:
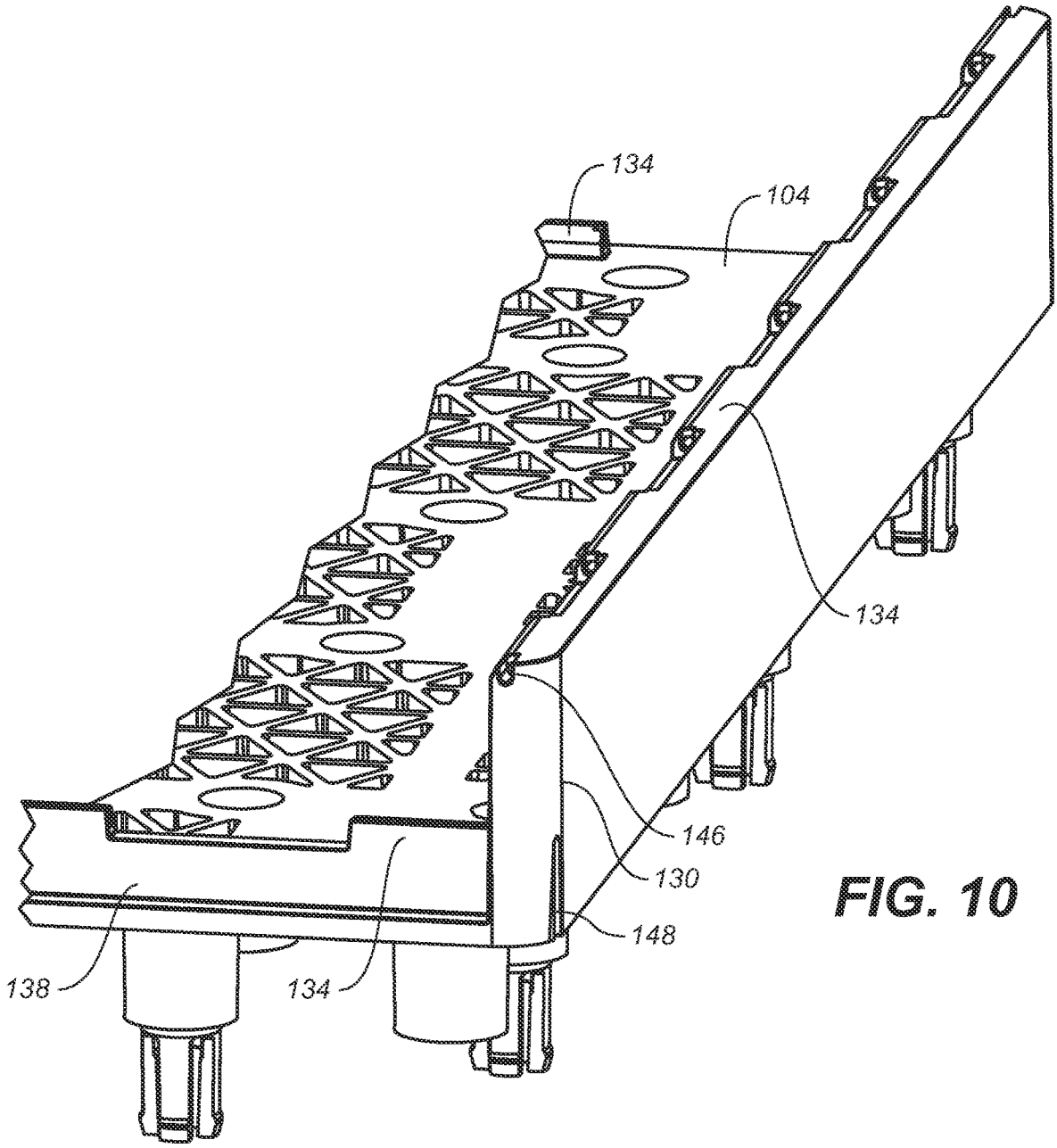
FIG. 10 depicts a detailed perspective view of the top portion alternating insertion and projection portions 134, the pallet top portion third upstanding side 138, and the pallet top portion first upstanding side 130 for an embodiment of the trackable nylon pallet and collapsible container.

All embodiments of the trackable nylon pallet and collapsible container 12 pallet top side 110 and the nylon pallet bottom side 106 include a nylon locking pin 54 to secure each upstanding nylon post with extended attachment clip 42 to each upstanding nylon post open end 36, FIGS. 3 and 8.

All embodiments of the trackable nylon pallet and collapsible container 12 include a communication/sensor box 600 sized to be received and releasably held by the corresponding equal sized frame sides between upstanding nylon posts of the bottom portion and top portion, FIGS. 2-4, 6, 8, and 19. The communication/sensor box 600, FIGS. 6 and 19, includes a rectangular open bottom portion 602 having attachment clips 606 on each external bottom portion length side, a global positioning antenna 612 affixed to the bottom surface of the bottom portion 602, a seal around the bottom portion open edge, and a threaded opening orthogonally disposed to the communication/sensor box bottom in each bottom portion corner. The communication/sensor box rectangular top portion 604 is sized to enclose the open bottom portion and includes a planar top surface, a threaded opening orthogonally disposed to the planar top surface in each top portion corner, a communication/sensor box vent 608 centered on the planar surface of top portion top planar surface is open through the communication/sensor box top portion 604 planar top surface, and an internal membrane below the vent hole and on a the bottom surface of the communication/sensor box top portion 604 top portion to provide for heat dissipation from, and gaseous airflow but not liquids into, the communication/sensor box 600 when the top portion is sealed to the bottom portion by four threaded fasteners 610 in the corners of the communication/sensor box top portion 604 and communication/sensor box bottom portion 602. The communication/sensor box 600 is sized to house at least one integral global positioning system, at least one integral radio frequency identification device, at least one integral temperature sensor, at least one integral sensor calibrated to detect chemicals, an integral power supply and connected wiring (not shown) to power the components housed in the communication/sensor box 600. The communication/sensor box bottom portion external surface side clips 606 are sized to engage and releasably attach to the respective frame sides 64 and 66 extending upwards from the pallet bottom portion top side 108, and the communication/sensor box top portion 604 top surface is sized to be received by and be secured by the corresponding frame sides 68 and 70 extending downwards from the pallet top portion bottom side 112, FIGS. 2-4, and 8. The communications/sensor box 600 can be removed quickly from pallet installation for repair or replacement without disassembly of the trackable nylon pallet and collapsible container 12.

Embodiments of the trackable nylon pallet and collapsible container 12 pallet 400 includes equal sized square top and bottom portions, 104 and 102, respectively, and four 1165 mm (~45.86 inches) pallet side lengths.

All disclosed embodiments of the trackable nylon pallet and collapsible container 12 pallet 100, FIGS. 1-4, can withstand a rack able load of 2,722 kg (6,001 lbs.), and a static load of 45,359 kg (100,000 lbs.).

All disclosed embodiments of the trackable nylon pallet and collapsible container 12 pallet 100 provide equipment entry passages between the pallet top portions 104 and pallet bottom portions 102 from all four pallet sides, FIGS. 1-4, without obstruction by or contact with the pallet connection and locking assembly points between the pallet bottom portion 102 and the pallet top portion 104.

For all disclosed embodiments of the trackable nylon pallet and collapsible container 12 the pallet 100, when each bottom portion top side 108 array of upstanding nylon posts connects and locks with a corresponding top portion bottom side 112 array of four upstanding nylon posts a low profile, high weight capacity pallet 100 is formed, the low profile, high weight capacity nylon pallet further comprising equipment entry passages between the nylon pallet top portion 104 and the nylon pallet bottom portion 102 from all four pallet sides, and real time tracking, identification, and monitoring capabilities, FIGS. 1-19.

The disclosed embodiments of the trackable nylon pallet and collapsible container 12 nylon pallet top portions 104 and the pallet bottom portions 102, upstanding nylon post open ends 36, upstanding nylon posts with extended attachment clip 42, and locking pins 54, first second, third and fourth collapsible sides, 162-168, respectively, and the collapsible sides cover 192 are manufactured from injection molded nylon consisting of post-consumer nylon, post-industrial nylon, and virgin nylon, all reinforced with glass, FIGS. 1-18.

Figure 19:
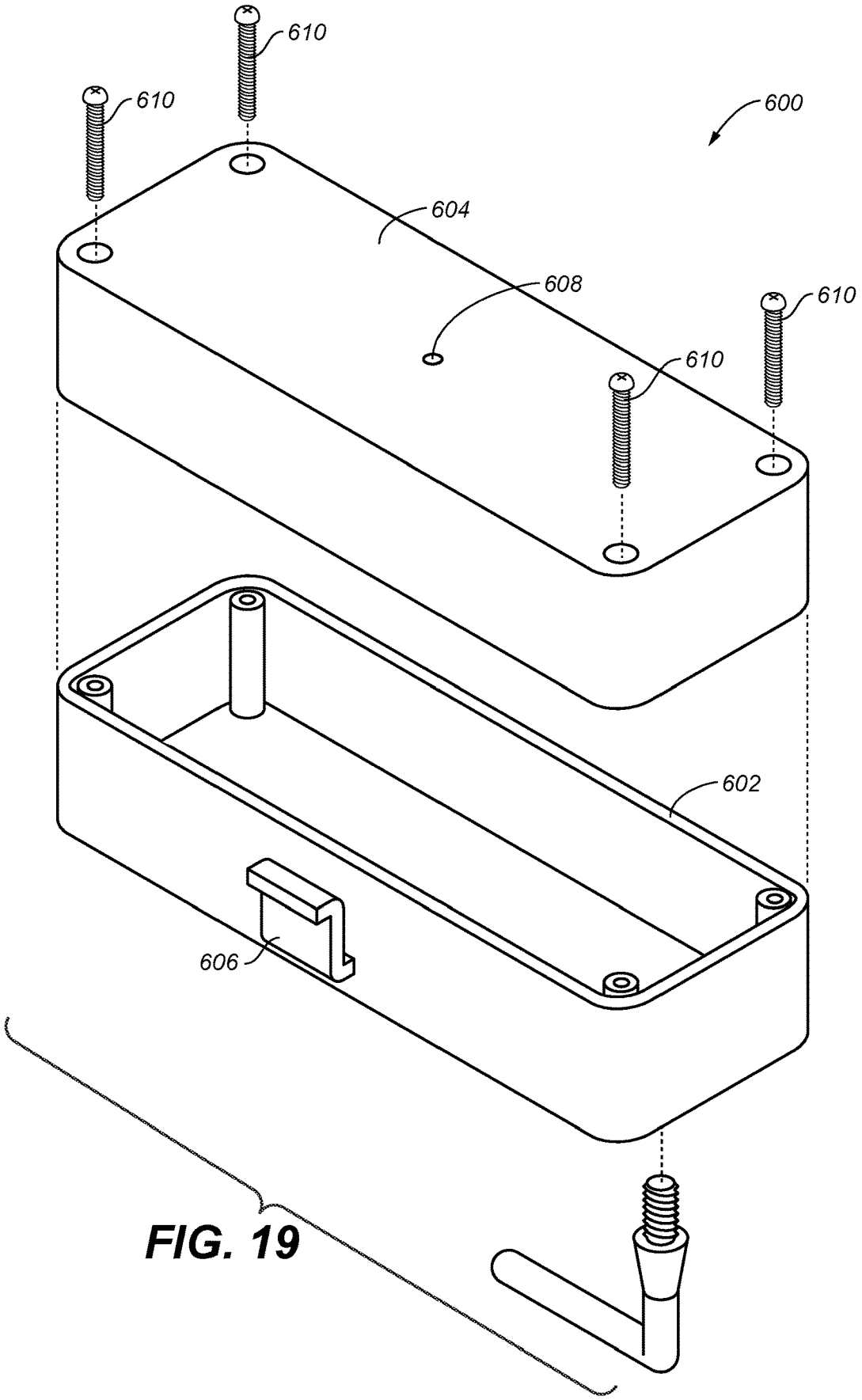
FIG. 19 is a is an exploded right top perspective view of communication/sensor box 600 for all embodiments of the trackable nylon pallet and collapsible container.

The disclosed communication/sensor box 600, FIGS. 6 and 19, including the box bottom 602, the box top 604, the box side clip 606 are manufactured from injection molded nylon consisting of post-consumer nylon, post-industrial nylon, and virgin nylon, all reinforced with carbon black.

We claim:

1. A trackable nylon pallet and collapsible container, in combination;

a) a rigid, injection molded nylon pallet bottom portion comprising a planar bottom side and a top side, four equal length sides providing two length sides and two width sides, four ninety-degree corners, a plurality of equal sized upstanding nylon posts affixed to the bottom portion top side in four equal sized arrays of four upstanding nylon posts in the four corners of the bottom portion top side, three equal sized arrays of four upstanding nylon posts along a central axis of the bottom portion length sides with two equal sized arrays near the center portion of each length side and the third equal array centered between the two arrays in the center of the bottom portion top side, and two equal sized arrays of four upstanding nylon posts along a central axis of the bottom portion width sides with one array near the center portion of each width side, whereby each equal sized array of four upstanding nylon posts comprises two diagonally disposed upstanding nylon posts further comprising extended nylon attachment clips and two diagonally opposed posts comprising an open end sized to receive an attachment clip, and wherein two equal sized arrays of four upstanding nylon posts along a central axis of the bottom portion width sides further comprise equal sized nylon frame sides between upstanding nylon posts, the frame sides orthogonally disposed to the central axis of the bottom portion width sides;

b) a rigid, injection molded nylon pallet top portion of equal size to the bottom portion and comprising a bottom side and a top side, four equal length sides providing two length sides and two width sides, two equal width sides, four ninety-degree corners, a plurality of equal sized upstanding nylon posts affixed to the top portion bottom side in four equal sized arrays of four upstanding nylon posts in the four corners of the top portion bottom side, three equal sized arrays of four upstanding nylon posts along a central axis of the top portion length sides with two equal sized arrays near the center portion of each top portion length side and the third equal array centered between the two arrays in the center of the top portion bottom side, and two equal sized arrays of four upstanding nylon posts along a central axis of the top portion width sides with one array near the center portion of each width side, whereby each equal sized array of four upstanding nylon posts comprises two diagonally disposed upstanding nylon posts further comprising extended nylon attachment clips and two diagonally opposed posts comprising an open end sized to receive an attachment clip wherein the two diagonally disposed upstanding nylon posts comprising extended attachment clips for each top portion array correspond to the two diagonally upstanding post open ends on a corresponding bottom side array, wherein two equal sized arrays of four upstanding nylon posts along a central axis of the top portion width sides further comprise equal sized nylon frame sides between upstanding nylon posts corresponding to the equal sized frame sides between upstanding nylon posts of the bottom portion, the frame sides orthogonally disposed to the central axis of the top portion width sides, and wherein the top side is substantially planar with a first upstanding side defining a planar height above the planar top side and an opposite a second upstanding side defining a lower planar height than that of the first upstanding side above the planar top side, a third upstanding side between the first upstanding side and the second upstanding side defining a lower planar height than that of the second upstanding side, and equal sized alternating insertion and projection portions along the first, second, and third upstanding sides and the other top side, and orthogonal apertures on each first, second and third upstanding end sized to receive and hold a hinge rod;

c) a nylon pallet locking pin to secure each upstanding post with extended attachment clip to each upstanding post open end whereby, when each bottom portion top side array of upstanding nylon posts connects with a corresponding top portion bottom side array of upstanding nylon posts a low profile, high weight capacity pallet is formed, the pallet further comprising equipment entry passages between the top and bottom portions from all four sides;

d) a first collapsible nylon side comprising a bottom side length comprising alternating insertion and projection portions with affixed hinge barrels corresponding to the alternating insertion and projection portions of the pallet planar top side defining a common longitudinal channel sized to receive the hinge rod, and a first collapsible side height sized to provide a common collapsible box height when all four collapsible sides connected to the pallet planar top side are positioned orthogonally to the pallet planar top side;

e) a second collapsible nylon side comprising a bottom side length comprising alternating insertion and projection portions with affixed hinge barrels corresponding to the alternating insertion and projection portions of the third upstanding side of the pallet planar top side defining a common longitudinal channel sized to receive the hinge rod, and a second collapsible side height sized to provide a common collapsible box height when all four collapsible sides connected to the pallet planar top side are positioned orthogonally to the pallet planar top side;

f) a third collapsible nylon side comprising a bottom side length comprising alternating insertion and projection portions with affixed hinge barrels corresponding to the alternating insertion and projection portions of the second upstanding side of the pallet planar top side defining a common longitudinal channel sized to receive a hinge rod, and a third collapsible side height sized to provide a common collapsible box height when all four collapsible sides connected to the pallet planar top side are positioned orthogonally to the pallet planar top side;

g) a fourth collapsible nylon side comprising a bottom side length comprising alternating insertion and projection portions with affixed hinge barrels corresponding to the alternating insertion and projection portions of the first upstanding side of the pallet planar top side defining a common longitudinal channel sized to receive a hinge rod, and a fourth collapsible side height sized to provide a common collapsible box height when all four collapsible sides connected to the pallet planar top side are positioned orthogonally to the pallet planar top side;

h) a nylon top cover comprising a top and four sides sized to receive and fit over the collapsible nylon sides when all four collapsible sides connected to the pallet planar top side are positioned orthogonally to the pallet planar top side or when all four collapsible sides are folded inwards on top of the pallet planar top side;

i) means for releasably locking and securing a top portion of the first and second collapsible sides to an adjacent top portion of the third and fourth collapsible sides when all four collapsible sides connected to the pallet planar top side are positioned orthogonally to the pallet planar top side;

j) the hinge rods sized to be received into each common longitudinal channel presented by each collapsible side bottom side length alternating insertion and projection portions with affixed hinge barrels and alternating insertion and projection portions and orthogonal apertures of the pallet planar top side; and k) at least one nylon communication/sensor box sized to be received and releasably held by the pallet frame sides, the sensor box comprising at least one integral global positioning system, at least one integral radio frequency identification device, at least one integral temperature sensor, at least one integral sensor calibrated to detect chemicals, an integral power supply and connected wiring to power components housed in the container providing real time tracking, identification, and monitoring capabilities;

whereby, when each pallet bottom portion top side array of upstanding nylon posts connects with a corresponding pallet top portion bottom side array of upstanding nylon posts and the collapsible sides are secured to the pallet top side by hinge rods and hinge barrels, a nylon pallet and collapsible container is formed comprising equipment entry passages between the top and bottom pallet portions from all four sides, and real time tracking, identification, and monitoring capabilities.

2. The trackable nylon pallet and collapsible container of claim 1, further comprising equal sized square pallet top and bottom portions each comprising four 1165 mm side lengths.

3. The trackable nylon pallet and collapsible container of claim 1, wherein the mean for releasably locking and securing a top portion of the first and second collapsible sides to an adjacent top portion of the third and fourth collapsible sides when all four collapsible sides connected to the pallet planar top side are positioned orthogonally to the pallet planar top side comprises in combination top a latch slidably positioned in an upper and lower track in the two top corners of the first and second collapsible sides and comprising an attached resilient elastic return member affixed to a track end in each first and second collapsible sides, latch locking clips sized to releasably engage track slots, and a latch tapered head sized to engage a corner of adjacent third and fourth collapsible sides, and comprising first and second collapsible side fittings sized to be releasably received by adjacent third and fourth collapsible side openings.

4. The trackable nylon pallet and collapsible container of claim 1, wherein the nylon top cover comprises four cylindrical stabilizers each centered on a quadrant of the nylon top cover, positioned and sized to be received by cylindrical openings on the pallet bottom portion, and wherein each cylindrical stabilizer comprises a cylindrical indent on an underside of the nylon top cover positioned and sized to receive a stabilizer cylindrical detent on an external surface of the fourth collapsible side when all collapsible sides are folded inwards and stacked on the pallet top side surface.

5. The trackable nylon pallet and collapsible container of claim 1, wherein nylon pallet top portions and the pallet bottom portions, upstanding nylon post open ends, upstanding nylon posts with extended attachment clip and locking pins, first second, third and fourth collapsible nylon sides, and the nylon top cover are manufactured from injection molded nylon consisting of post-consumer nylon, post-industrial nylon, and virgin nylon, all reinforced with glass.

6. The trackable nylon pallet and collapsible container of claim 1, wherein the at least one nylon communication/sensor box, comprising a box bottom, a box top, and a box side clip is manufactured from injection molded nylon consisting of post-consumer nylon, post-industrial nylon, and virgin nylon, all reinforced with carbon black.

7. A trackable nylon pallet and collapsible container comprising, in combination;

a) a rigid, injection molded nylon pallet comprising a square bottom portion comprising interlocking assemblies to attach to an equal sized rigid injection molded top portion comprising interlocking assemblies, the top portion further comprising a substantially planar top side comprising a first upstanding side defining a planar height above the planar top side and an opposite a second upstanding side defining a lower planar height than that of the first upstanding side above the planar top side, a third upstanding side between the first upstanding side and the second upstanding side defining a lower planar height than that of the second upstanding side, and equal sized alternating insertion and projection portions along the first, second, and third upstanding sides and the other top side defining longitudinal channels sized to receive a hinge rod, and orthogonal apertures on each first, second and third upstanding end sized to receive and hold the hinge rod;

b) a first collapsible nylon side comprising a bottom side length comprising alternating insertion and projection portions with affixed hinge barrels corresponding to alternating insertion and projection portions of the planar top side of the pallet top portion defining a common longitudinal channel sized to receive the hinge rod, and a first collapsible side height sized to provide a common collapsible box height when all four collapsible sides connected to the pallet planar top side are positioned orthogonally to the pallet planar top side;

c) a second collapsible nylon side comprising a bottom side length comprising alternating insertion and projection portions with affixed hinge barrels corresponding to the alternating insertion and projection portions of the third upstanding side of the pallet planar top side defining a common longitudinal channel sized to receive the hinge rod, and a second collapsible side height sized to provide a common collapsible box height when all four collapsible sides connected to the pallet planar top side are positioned orthogonally to the pallet planar top side;

d) a third collapsible nylon side comprising a bottom side length comprising alternating insertion and projection portions with affixed hinge barrels corresponding to the alternating insertion and projection portions of the second upstanding side of the pallet planar top side defining a common longitudinal channel sized to receive the hinge rod, and a third collapsible side height sized to provide a common collapsible box height when all four collapsible sides connected to the pallet planar top side are positioned orthogonally to the pallet planar top side;

e) a fourth collapsible nylon side comprising a bottom side length comprising alternating insertion and projection portions with affixed hinge barrels corresponding to the alternating insertion and projection portions of the first upstanding side of the pallet planar top side defining a common longitudinal channel sized to receive the hinge rod, and a fourth collapsible side height sized to provide a common collapsible box height when all four collapsible sides connected to the pallet planar top side are positioned orthogonally to the pallet planar top side;

f) a nylon top cover comprising a top and four sides sized to receive and fit over the collapsible nylon sides when all four collapsible sides connected to the pallet planar top side are positioned orthogonally to the pallet planar top side or when all four collapsible sides are folded inwards on top of the pallet planar top side;

g) means for releasably locking and securing a top portion of the first and second collapsible sides to an adjacent top portion of the third and fourth collapsible sides when all four collapsible sides connected to the pallet planar top side are positioned orthogonally to the pallet planar top side;

h) four hinge rods sized to be received into each common longitudinal channel presented by each collapsible side bottom side length alternating insertion and projection portions with affixed hinge barrels and alternating insertion and projection portions and orthogonal apertures of the pallet planar top side; and i) at least one nylon communication/sensor box sized to be received and releasably held by and within the pallet, the box comprising at least one integral global positioning system, at least one integral radio frequency identification device, at least one integral temperature sensor, and at least one integral sensor calibrated to detect chemicals;

whereby, when the collapsible sides are secured to the pallet top side by the hinge rods and hinge barrels, a trackable nylon pallet and collapsible container is formed comprising equipment entry passages between the top and bottom pallet portions from all four sides, a cover, and real time tracking, identification, and monitoring capabilities.

8. The nylon pallet of claim 7, further comprising four 1165 mm side lengths.

9. The trackable nylon pallet and collapsible container of claim 8, wherein the means for releasably locking and securing a top portion of the first and second collapsible sides to an adjacent top portion of the third and fourth collapsible sides when all four collapsible sides connected to the pallet planar top side are positioned orthogonally to the pallet planar top side comprises in combination a latch slidably positioned in an upper and lower track in two top corners of the first and second collapsible sides and comprising an attached resilient elastic return member affixed to a track end in each first and second collapsible sides, latch locking clips sized to releasably engage track slots, and a latch tapered head sized to engage a corner of adjacent third and fourth collapsible sides, and comprising first and second collapsible side fittings sized to be releasably received by adjacent third and fourth collapsible side openings.

10. The trackable nylon pallet and collapsible container of claim 9, wherein the nylon top cover comprises four cylindrical stabilizers each centered on a quadrant of the nylon top cover, positioned and sized to be received by cylindrical openings on a pallet bottom portion, and wherein each cylindrical stabilizer comprises a cylindrical indent on an underside of the nylon top cover positioned and sized to receive a cylindrical stabilizer detent on an external surface of the fourth collapsible side when all collapsible sides are folded inwards and stacked on the pallet top side surface.

11. The trackable nylon pallet and collapsible container of claim 10, wherein a) the rigid, injection molded nylon pallet square bottom portion comprises a planar bottom side and a top side, four equal length sides providing two length sides and two width sides, four ninety-degree corners, a plurality of equal sized upstanding nylon posts affixed to the bottom portion top side in four equal sized arrays of four upstanding nylon posts in the four corners of the bottom portion top side, three equal sized arrays of four upstanding nylon posts along a central axis of the bottom portion length sides with two equal sized arrays near the center portion of each length side and the third equal array centered between the two arrays in the center of the bottom portion top side, and two equal sized arrays of four upstanding nylon posts along a central axis of the bottom portion width sides with one array near the center portion of each width side, whereby each equal sized array of four upstanding nylon posts comprises two diagonally disposed upstanding nylon posts further comprising extended nylon attachment clips and two diagonally opposed posts comprising an open end sized to receive an attachment clip, and wherein two equal sized arrays of four upstanding nylon posts along a central axis of the bottom portion width sides further comprise equal sized nylon frame sides between upstanding nylon posts, the frame sides orthogonally disposed to the central axis of the bottom portion width sides, the frame sides sized to receive and releasably hold the at least one container;

b) the rigid, injection molded nylon pallet square top portion of equal size to the bottom portion and comprising a bottom side and the top side, four equal length sides providing two length sides and two width sides, two equal width sides, four ninety-degree corners, a plurality of equal sized upstanding nylon posts affixed to the top portion bottom side in four equal sized arrays of four upstanding nylon posts in the four corners of the top portion bottom side, three equal sized arrays of four upstanding nylon posts along a central axis of the top portion length sides with two equal sized arrays near the center portion of each top portion length side and the third equal array centered between the two arrays in the center of the top portion bottom side, and two equal sized arrays of four upstanding nylon posts along a central axis of the top portion width sides with one array near the center portion of each width side, whereby each equal sized array of four upstanding nylon posts comprises two diagonally disposed upstanding nylon posts further comprising extended nylon attachment clips and two diagonally opposed posts comprising an open end sized to receive an attachment clip wherein the two diagonally disposed upstanding nylon posts comprising extended attachment clips for each top portion array correspond to the two diagonally upstanding post open ends on a corresponding bottom side array, wherein two equal sized arrays of four upstanding nylon posts along a central axis of the top portion width sides further comprise equal sized nylon frame sides between upstanding nylon posts corresponding to the equal sized frame sides between upstanding nylon posts of the bottom portion, the frame sides orthogonally disposed to the central axis of the top portion width sides and sized to receive and releasably hold the at least one container; and c) a nylon pallet locking pin to secure each upstanding post with extended attachment clip to each upstanding post open end whereby, when each bottom portion top side array of upstanding nylon posts connects with a corresponding top portion bottom side array of upstanding nylon posts a low profile, high weight capacity pallet is formed, the pallet further comprising equipment entry passages between the top and bottom portions from all four sides;

whereby, when each pallet bottom portion top side array of upstanding nylon posts connects with a corresponding pallet top portion bottom side array of upstanding nylon posts, a nylon pallet is formed.

12. The trackable nylon pallet and collapsible container of claim 11, wherein nylon pallet top portions and the pallet bottom portions, upstanding nylon post open ends, upstanding nylon posts with extended attachment clip and locking pins, first second, third and fourth collapsible sides, and the cover are manufactured from injection molded nylon consisting of post-consumer nylon, post-industrial nylon, and virgin nylon, all reinforced with glass.

13. The trackable nylon pallet and collapsible container of claim 12, wherein the at least one nylon communication/sensor box, comprising a box bottom, a box top, and a box side clip is manufactured from injection molded nylon consisting of post-consumer nylon, post-industrial nylon, and virgin nylon, all reinforced with carbon black.

14. The trackable nylon pallet and collapsible container of claim 11, further comprising equal sized square pallet top and bottom portions each comprising four 1165 mm side lengths.

15. A trackable nylon pallet and collapsible container, in combination;

a) a rigid, injection molded nylon pallet bottom portion comprising a planar bottom side and a top side, four equal length sides providing two length sides and two width sides, four ninety-degree corners, a plurality of equal sized upstanding nylon posts affixed to the bottom portion top side in four equal sized arrays of four upstanding nylon posts in the four corners of the bottom portion top side, three equal sized arrays of four upstanding nylon posts along a central axis of the bottom portion length sides with two equal sized arrays near the center portion of each length side and the third equal array centered between the two arrays in the center of the bottom portion top side, and two equal sized arrays of four upstanding nylon posts along a central axis of the bottom portion width sides with one array near the center portion of each width side, whereby each equal sized array of four upstanding nylon posts comprises two diagonally disposed upstanding nylon posts further comprising extended nylon attachment clips and two diagonally opposed posts comprising an open end sized to receive an attachment clip, and wherein two equal sized arrays of four upstanding nylon posts along a central axis of the bottom portion width sides further comprise equal sized nylon frame sides between upstanding nylon posts, the frame sides orthogonally disposed to the central axis of the bottom portion width sides;

b) a rigid, injection molded nylon pallet top portion of equal size to the bottom portion and comprising a bottom side and a top side, four equal length sides providing two length sides and two width sides, two equal width sides, four ninety-degree corners, a plurality of equal sized upstanding nylon posts affixed to the top portion bottom side in four equal sized arrays of four upstanding nylon posts in the four corners of the top portion bottom side, three equal sized arrays of four upstanding nylon posts along a central axis of the top portion length sides with two equal sized arrays near the center portion of each top portion length side and the third equal array centered between the two arrays in the center of the top portion bottom side, and two equal sized arrays of four upstanding nylon posts along a central axis of the top portion width sides with one array near the center portion of each width side, whereby each equal sized array of four upstanding nylon posts comprises two diagonally disposed upstanding nylon posts further comprising extended nylon attachment clips and two diagonally opposed posts comprising an open end sized to receive an attachment clip wherein the two diagonally disposed upstanding nylon posts comprising extended attachment clips for each top portion array correspond to the two diagonally upstanding post open ends on a corresponding bottom side array, wherein two equal sized arrays of four upstanding nylon posts along a central axis of the top portion width sides further comprise equal sized nylon frame sides between upstanding nylon posts corresponding to the equal sized frame sides between upstanding nylon posts of the bottom portion, the frame sides orthogonally disposed to the central axis of the top portion width sides, and wherein the top side is substantially planar with a first upstanding side defining a planar height above the planar top side and an opposite a second upstanding side defining a lower planar height than that of the first upstanding side above the planar top side, a third upstanding side between the first upstanding side and the second upstanding side defining a lower planar height than that of the second upstanding side, and equal sized alternating insertion and projection portions along the first, second, and third upstanding sides and the other top side, and orthogonal apertures on each first, second and third upstanding end sized to receive and hold a hinge rod;

c) a nylon pallet locking pin to secure each upstanding post with extended attachment clip to each upstanding post open end whereby, when each bottom portion top side array of upstanding nylon posts connects with a corresponding top portion bottom side array of upstanding nylon posts a low profile, high weight capacity pallet is formed, the pallet further comprising equipment entry passages between the top and bottom portions from all four sides;

d) a first collapsible nylon side comprising a bottom side length comprising alternating insertion and projection portions with affixed hinge barrels corresponding to the alternating insertion and projection portions of the pallet planar top side defining a common longitudinal channel sized to receive the hinge rod, and a first collapsible side height sized to provide a common collapsible box height when all four collapsible sides connected to the pallet planar top side are positioned orthogonally to the pallet planar top side;

e) a second collapsible nylon side comprising a bottom side length comprising alternating insertion and projection portions with affixed hinge barrels corresponding to the alternating insertion and projection portions of the third upstanding side of the pallet planar top side defining a common longitudinal channel sized to receive the hinge rod, and a second collapsible side height sized to provide a common collapsible box height when all four collapsible sides connected to the pallet planar top side are positioned orthogonally to the pallet planar top side;

f) a third collapsible nylon side comprising a bottom side length comprising alternating insertion and projection portions with affixed hinge barrels corresponding to the alternating insertion and projection portions of the second upstanding side of the pallet planar top side defining a common longitudinal channel sized to receive the hinge rod, and a third collapsible side height sized to provide a common collapsible box height when all four collapsible sides connected to the pallet planar top side are positioned orthogonally to the pallet planar top side;

g) a fourth collapsible nylon side comprising a bottom side length comprising alternating insertion and projection portions with affixed hinge barrels corresponding to the alternating insertion and projection portions of the first upstanding side of the pallet planar top side defining a common longitudinal channel sized to receive the hinge rod, and a fourth collapsible side height sized to provide a common collapsible box height when all four collapsible sides connected to the pallet planar top side are positioned orthogonally to the pallet planar top side;

h) a nylon top cover comprising a top and four sides sized to receive and fit over the collapsible nylon sides when all four collapsible sides connected to the pallet planar top side are positioned orthogonally to the pallet planar top side or when all four collapsible sides are folded inwards on top of the pallet planar top side;

i) a releasable locking assembly securing a top portion of the first and second collapsible sides to an adjacent top portion of the third and fourth collapsible sides when all four collapsible sides connected to the pallet planar top side are positioned orthogonally to the pallet planar top side comprising a latch slidably positioned in an upper and lower track in the two top corners of the first and second collapsible sides, the releasable locking assembly comprising an attached resilient elastic return member affixed to a track end in each first and second collapsible sides, latch locking clips sized to releasably engage track slots, and a latch tapered head sized to engage a corner of adjacent third and fourth collapsible sides, and comprising first and second collapsible side fittings sized to be releasably received by adjacent third and fourth collapsible side openings;

j) four hinge rods each sized to be received into each common longitudinal channel presented by each collapsible side bottom side length alternating insertion and projection portions with affixed hinge barrels and alternating insertion and projection portions and orthogonal apertures of the pallet planar top side; and k) at least one nylon communication/sensor box sized to be received and releasably held by the pallet frame sides, the container comprising at least one integral global positioning system, at least one integral radio frequency identification device, at least one integral temperature sensor, at least one integral sensor calibrated to detect chemicals, an integral power supply and connected wiring to power components housed in the container providing real time tracking, identification, and monitoring capabilities;

whereby, when each pallet bottom portion top side array of upstanding nylon posts connects with a corresponding pallet top portion bottom side array of upstanding nylon posts and the collapsible sides are secured to the pallet top side by the hinge rods and the hinge barrels, a nylon pallet and collapsible container is formed comprising equipment entry passages between the top and bottom pallet portions from all four sides, and real time tracking, identification, and monitoring capabilities.

16. The trackable nylon pallet and collapsible container of claim 15, wherein nylon pallet top portions and the pallet bottom portions, upstanding nylon post open ends, upstanding nylon posts with extended attachment clip and locking pins, first second, third and fourth collapsible nylon sides, and the nylon top cover are manufactured from injection molded nylon consisting of post-consumer nylon, post-industrial nylon, and virgin nylon, all reinforced with glass.

17. The trackable nylon pallet and collapsible container of claim 15, wherein the at least one nylon communication/sensor box, comprising a box bottom, a box top, and a box side clip is manufactured from injection molded nylon consisting of post-consumer nylon, post-industrial nylon, and virgin nylon, all reinforced with carbon black.

18. The trackable nylon pallet and collapsible container of claim 15, further comprising equal sized square pallet top and bottom portions each comprising four 1165 mm side lengths.

* * * * *